US009179726B2

(12) United States Patent
Hanover et al.

(10) Patent No.: US 9,179,726 B2
(45) Date of Patent: Nov. 10, 2015

(54) WEARABLE UTILITY INSTRUMENT ASSEMBLY

(76) Inventors: Yaron Hanover, Tel Aviv (IL); Dov Ganchrow, Har Adar (IL)

( * ) Notice: Subject to any disclaimer, the term of this patent is extended or adjusted under 35 U.S.C. 154(b) by 263 days.

(21) Appl. No.: 13/591,344

(22) Filed: Aug. 22, 2012

(65) Prior Publication Data

US 2013/0047317 A1 Feb. 28, 2013

Related U.S. Application Data

(60) Provisional application No. 61/525,856, filed on Aug. 22, 2011.

(30) Foreign Application Priority Data

Nov. 27, 2011 (IL) ..... 216632

(51) Int. Cl.

| | |
|---|---|
| ***A42B 1/24*** | (2006.01) |
| ***F41H 1/04*** | (2006.01) |
| ***F41B 13/04*** | (2006.01) |
| ***F41B 13/08*** | (2006.01) |
| ***F41B 15/00*** | (2006.01) |
| ***F41B 15/08*** | (2006.01) |
| ***F41C 33/04*** | (2006.01) |

(52) U.S. Cl.

CPC . *A42B 1/24* (2013.01); *F41B 13/04* (2013.01); *F41B 13/08* (2013.01); *F41B 15/00* (2013.01); *F41B 15/08* (2013.01); *F41C 33/048* (2013.01); *F41H 1/04* (2013.01)

(58) Field of Classification Search

CPC ..... A42B 1/23; F41B 13/04
USPC ..... 2/209.12, 209.13, 209.14
See application file for complete search history.

(56) References Cited

U.S. PATENT DOCUMENTS

| | | | | | |
|---|---|---|---|---|---|
| 1,506,815 | A * | 9/1924 | Cormay | 2/10 |
| 4,313,230 | A | 2/1982 | Chovaniec | |
| 4,535,987 | A * | 8/1985 | Dikoff | 473/406 |
| 4,807,362 | A | 2/1989 | Prentice | |
| 5,056,164 | A * | 10/1991 | Lisle et al. | 2/453 |
| 5,401,019 | A * | 3/1995 | Wissman et al. | 473/286 |
| 5,645,500 | A * | 7/1997 | Borden | 473/408 |
| 5,692,237 | A | 12/1997 | Bennett | |
| 6,174,058 | B1 * | 1/2001 | Hsiao | 351/155 |
| 6,477,714 | B1 * | 11/2002 | Boatwright | 2/171 |
| D488,292 | S * | 4/2004 | Haggberg | D2/866 |
| 6,735,779 | B1 * | 5/2004 | Shrem | 2/12 |
| 7,631,368 | B1 | 12/2009 | Samson | |
| 7,761,928 | B2 * | 7/2010 | Wang | 2/10 |
| D705,527 | S * | 5/2014 | Clark | D2/882 |
| 2007/0107113 | A1 | 5/2007 | Mansfield | |
| 2007/0271679 | A1 * | 11/2007 | Wysopal | 2/209.13 |
| 2008/0198579 | A1 * | 8/2008 | Crye et al. | 362/106 |
| 2008/0229470 | A1 * | 9/2008 | Kim | 2/12 |

FOREIGN PATENT DOCUMENTS

GB 2430480 A 3/2007

* cited by examiner

*Primary Examiner* — Anna Kinsaul

(74) *Attorney, Agent, or Firm* — Paul D. Bianco; Martin Fleit; Fleit Gibbons Gutman Bongini & Bianco PL

(57) ABSTRACT

A wearable utility instrument assembly including a headgear and at least one utility instrument. The utility instrument is shaped and sized to be securely retained and concealed within the brim portion of the headgear. The utility instrument is removable from the brim portion and deployed via a hand-grip of the utility instrument that is accessible to the wearer of the headgear while the utility instrument is retained in the brim portion.

19 Claims, 17 Drawing Sheets

WEARABLE UTILITY INSTRUMENT ASSEMBLY

FIELD OF THE DISCLOSED TECHNIQUE

The disclosed technique generally relates to hats and articles of clothing, and to concealed weapon arrangements.

BACKGROUND OF THE DISCLOSED TECHNIQUE

Many individuals, particularly military and security personnel but also ordinary citizens, may find themselves in situations in which they are forced to rapidly deal with an armed assailant or a general potential for violence. In such circumstances, it is desirable to have access to a suitable weapon which can be swiftly utilized to dispel the assailant and to safely avert or handle the violent situation while minimizing potential injury or harm to oneself and to associates and innocent bystanders. However, if the assailant is aware of the presence of the weapon, he may choose to retaliate in a more violent manner than he otherwise would, or attempt to obtain or immobilize the weapon before initiating his attack, thereby leaving the individual in a more precarious and possibly defenseless position. Furthermore, the individual may find himself situated in a particular location, such as a privately secured property, in which the carrying of weapons is disallowed or discouraged, and so it is desirable to conceal the presence of a carried weapon in such scenarios.

Various techniques are applied for concealing weapons in a manner which leaves them accessible for swift deployment, and various products and accessories have been developed for such purposes. For example, a weapon may be inserted or otherwise secured to a garment in such a manner that it is not clearly visible to others, such as carrying a gun in a holster located behind a lower pant leg. A jacket or coat may include an inner lining which is adapted to hide a knife or other small-sized weapon. Other garments and articles of clothing, such as belts, vests, pants, shoes, and the like are known in the art to be adapted in such a manner as to be able to incorporate various types of weapons and self-defense tools for the person who wears them. However, these techniques may not provide absolute concealment, and also run the risk of detection by metal detectors or similar devices adapted to detect the presence of weaponry. Furthermore, access to the weapon may be relatively cumbersome and time-consuming, diminishing valuable response time while the individual is attempting to retrieve the weapon.

U.K. Patent Application No. 2,430,480 to Raffles-Taylor, entitled "A personal defence aid", is directed to an assembly for personal defensive use by police or other security personnel. The assembly includes a concaved circular stainless steel disc that is inserted into the crown of a cap, enabling the cap to be held as a shield in the event of a knife attack. The disc may be covered on the inside concave with vinyl-backed fabric. A strip of nylon webbing may be stretched across the concaved side to form a hand-grip. There may be notches in the side of the disc to prevent sideways movement of the nylon webbing. The disc may be inserted into a cap via an insertion tool, used similar to a shoe horn.

U.S. Pat. No. 4,313,230 to Chovaniec, entitled "Belt for a concealed quick-draw knife", discloses a belt having a holster that serves to conceal and engage a knife. The holster is formed with a first curvature while the knife is formed with a second and different curvature (e.g., slightly more acute or accentuate), such that the knife is securely held within the holster by frictional contact, allowing quick and simple withdrawal of the knife from the holster. The belt may include a buckle for buckling the belt together (e.g., a hook), where the buckle is coupled to only to the holster and does not attach or interfere with the knife, allowing the weapon to be withdrawn without having to unbuckle or otherwise manipulate the belt.

U.S. Pat. No. 4,807,362 to Prentice, entitled "Hidden belt weapon", is directed to a weapon that is hidden in a supporting belt and can be detached from the belt by a twisting motion and deploys into a throwing-star/"ninja-star" configuration. The weapon includes front and back covers, and a central rotating member mounted within the back cover. A plurality of knife blades (preferably four) are rotatably attached to the central rotating member via respective blade deployment pins. The rotating member and knife blades are concealed by the cover when in a collapsed state, allowing the weapon to be carried over a belt buckle. By grasping and twisting the cover, the blades deploy to an extended position with the blade tips exterior to the cover, while releasing the cover from a securing attachment shaft.

Additional articles of clothing adapted for concealing weapons can be found in U.S. Pat. No. 5,692,237 to Bennett, entitled "Weapon concealment system"; U.S. Pat. No. 7,631,368 to Samson, entitled "Combined concealed carry holster undergarment and outergarment with quick release and quick access mechanisms"; and U.S. Patent Application Publication No. 2007/0107113 to Mansfield Jr., entitled "Karate cap".

SUMMARY OF THE DISCLOSED TECHNIQUE

In accordance with one aspect of the disclosed technique, there is thus provided a wearable utility instrument assembly. The wearable utility instrument assembly includes a headgear and at least one utility instrument. The headgear includes a brim portion protruding from a crown portion. The utility instrument is shaped and sized to be securely retained within the brim portion and concealed therein. The utility instrument is removable from the brim portion and deployed via a hand-grip of the utility instrument that is accessible to the wearer of the headgear while the utility instrument is retained within the brim portion. The utility instrument may be retained within an interior pocket of the brim portion. The pocket may be formed underneath a bottom surface of the brim portion. The utility instrument may be integrally formed together with the brim portion. The utility instrument may be fixedly attached to at least a portion of the bottom surface of the brim portion. A portion of the utility instrument may be sheathed within the pocket, while another portion of the utility instrument may be unsheathed in a concealed manner. The utility instrument may form the brim portion, which is detachable from the crown portion of the headgear. The brim portion may be removably attached to the crown portion via at least one fastener. The utility instrument may be removably attached to the brim portion via at least one fastener. The fastener may include: at least one clip, at least one Velcro® (i.e. hook and loop) fastener, at least one magnet, at least one button, at least one pin, at least one snap, or at least one zipper. The hand-grip may include a central gap and hand grip portion of the utility instrument. The utility instrument may be a weapon. The weapon may include an arc-shaped front edge, an arc-shaped rear edge, arc-shaped side edges, and blades disposed on respective sides of the front edge. The weapon may further include at least one trap inlet, indented onto an inner corner of one of the blades, and configured to ensnare or deflect away a weapon of an assailant. The weapon may further include a pressure focusing point, disposed on the front edge, and configured to provide impact when striking an assailant or to direct a strike against a particular body region. The weapon may further include at least one thumb rest, disposed at a corner of a respective one of the side edges, and configured for resting a thumb against when gripping the weapon. The weapon may further include a frontal blade, disposed on the front edge. The weapon may further include a lanyard hole, configured for inserting a lanyard therethrough to enable the weapon to be secured to the wearer while being wielded, carried or worn, or withdrawn from the brim portion, via the lanyard. The weapon blades may include a serrated edge. The wearable utility instrument assembly may further include a weapon sheath, which is securely retained and concealed within the brim portion, the weapon being sheathed within the weapon sheath. The weapon sheath may be fixedly attached to the brim portion, or may be removably attached to the brim portion. The weapon may be withdrawn and deployed together with the weapon sheath. The weapon may include: a crescent-shaped weapon, brass knuckles, a double-bladed knife, a boomerang weapon, a karambit, a push dagger, a knife, or a hira-shuriken (ninja star). The utility instrument may be composed of plastic, metal, or a composite material. The headgear may include: an open-top visor, a baseball cap, a double-brimmed hat, a motorcycle helmet, a bicycle helmet, a firefighting helmet, a construction helmet, a cowboy hat, a sun hat, a sombrero, or a yarmulke. The brim portion may be reinforced to provide additional support. The utility instrument may include a covering, operative to conceal the features of the utility instrument. The utility instrument may include: a cord cutter, a bottle opener, an Allen/hex-bit socket wrench head, a cylinder wrench head, a knife, a serrated blade, a screwdriver bit holder, a screw bit magazine, screwdriver bits, a rigid front edge/brass knuckles, a shank carbide burr, a flashlight, a fire starter, a fishing hook, a fishing line, an alarm, a USB port, a magnifying glass, tweezers, a mirror, a flattened edge/crowbar, a shackle/carabiner, a compass, a GPS unit, matches, batteries, a whistle, a flare, a file, or a marlinspike. The headgear may include a pocket for holding at least one accessory associated with the utility instrument.

In accordance with another aspect of the disclosed technique, there is thus provided a utility instrument adapted to be securely retained and concealed within a brim portion of a wearable headgear. The utility instrument includes a hand-grip that is accessible to the wearer of the headgear while the utility instrument is retained within the brim portion and enabling the wearer to remove the utility instrument from the brim portion to deploy the utility instrument. The utility instrument may be a weapon.

In accordance with a further aspect of the disclosed technique, there is thus provided a wearable headgear with a brim portion protruding from a crown portion, where a utility instrument is adapted to be securely retained within the brim portion and concealed therein. The utility instrument includes a hand-grip that is accessible to the wearer of the headgear while the utility instrument is retained within the brim portion and enabling the wearer to remove the utility instrument from the brim portion to deploy the utility instrument. The utility instrument may be a weapon.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a wearable weapon assembly allowing a user to retain and conceal a weapon within a hat or other type of headgear that is being worn by the user, in a manner that avoids detection of the weapon while enabling swift deployment of the weapon when required.

Figure 1A:
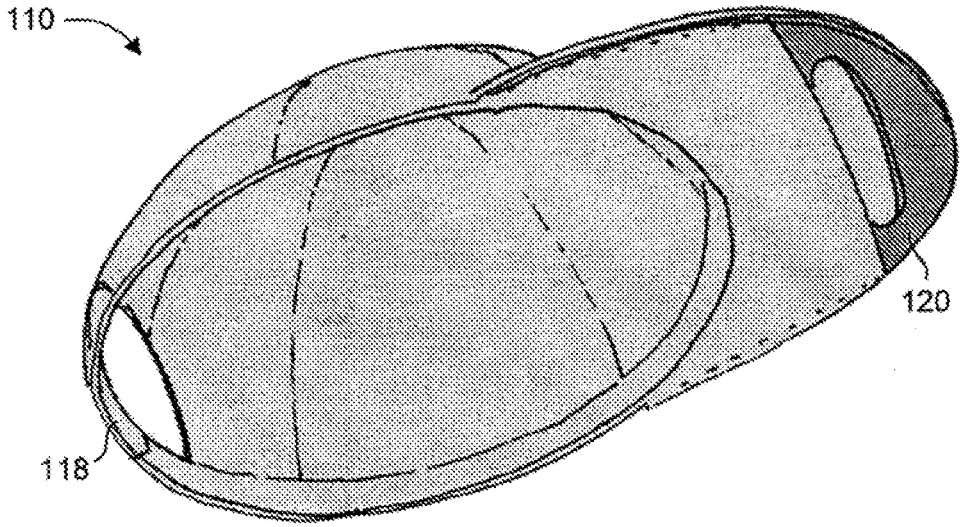
FIG. 1A is a bottom perspective view schematic illustration of a cap for securely retaining and concealing a weapon, constructed and operative in accordance with an embodiment of the disclosed technique.
Figure 1B:
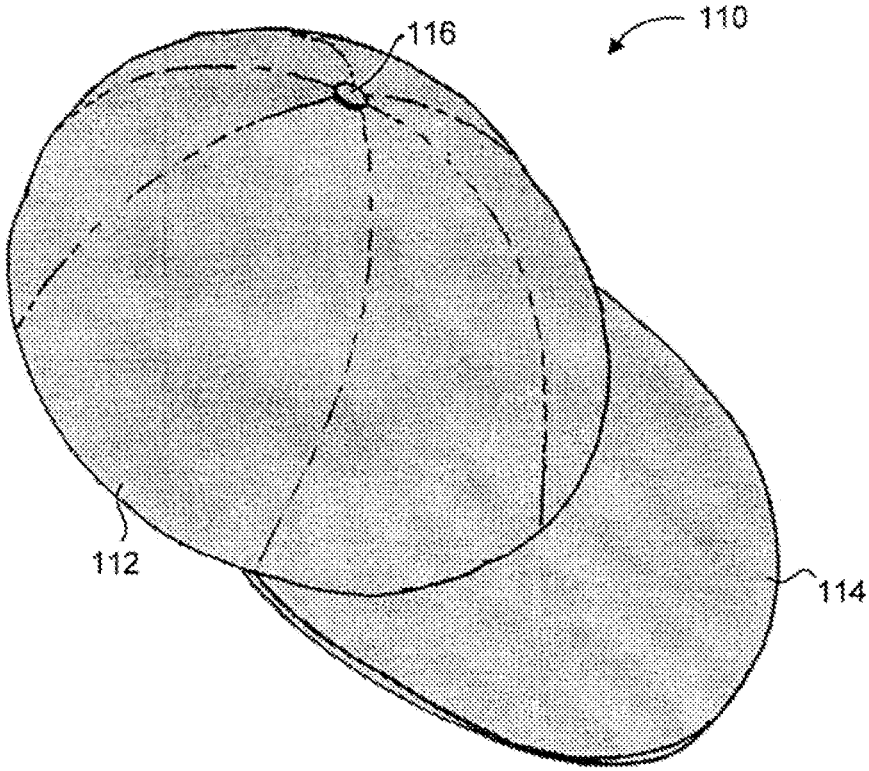
FIG. 1B is a top perspective view schematic illustration of the cap of FIG. 1A.
Figure 2:
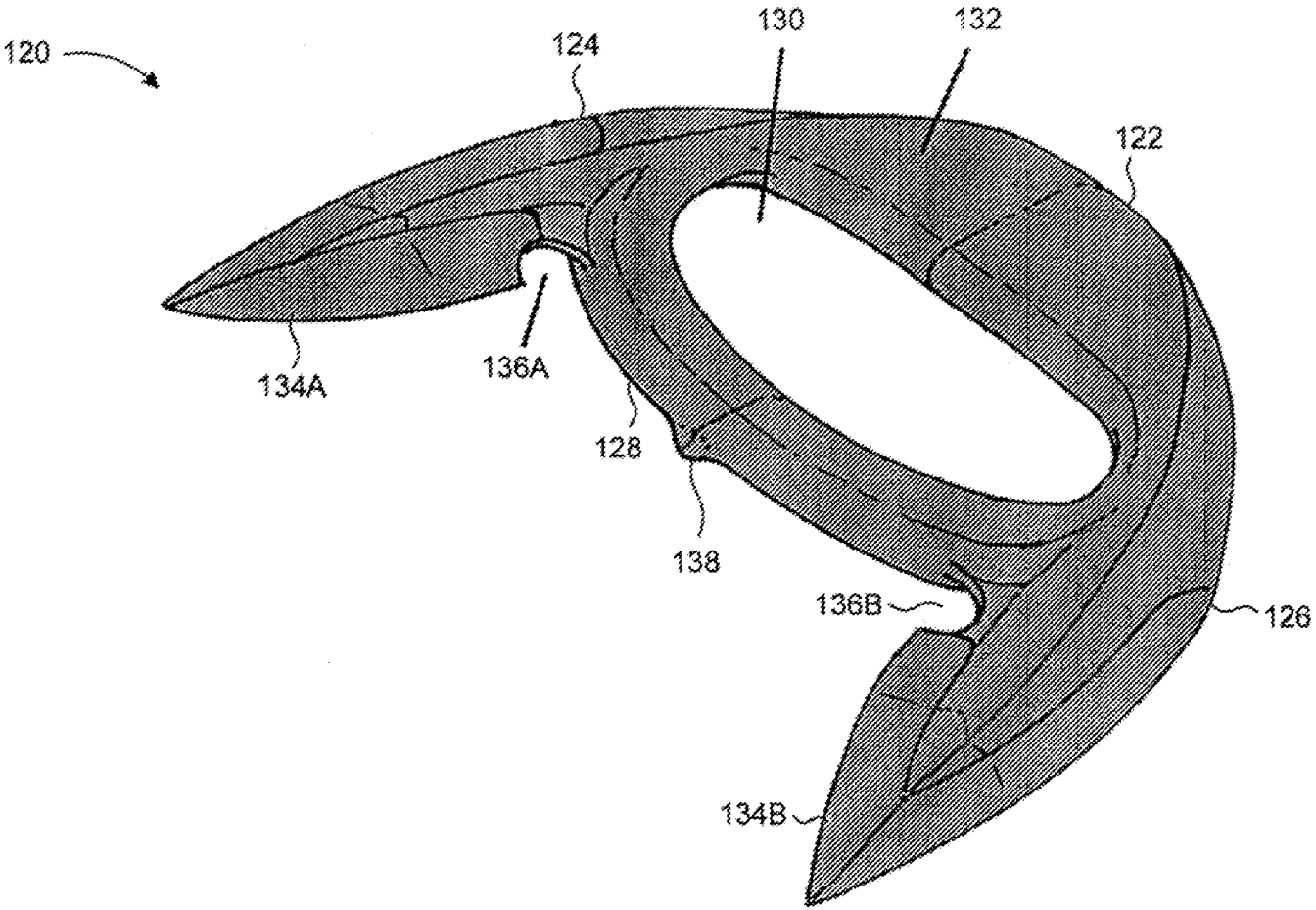
FIG. 2 is a top perspective view schematic illustration of a weapon adapted to be retained and concealed within the cap of FIGS. 1A and 1B, constructed and operative in accordance with an embodiment of the disclosed technique.
Figure 3A:
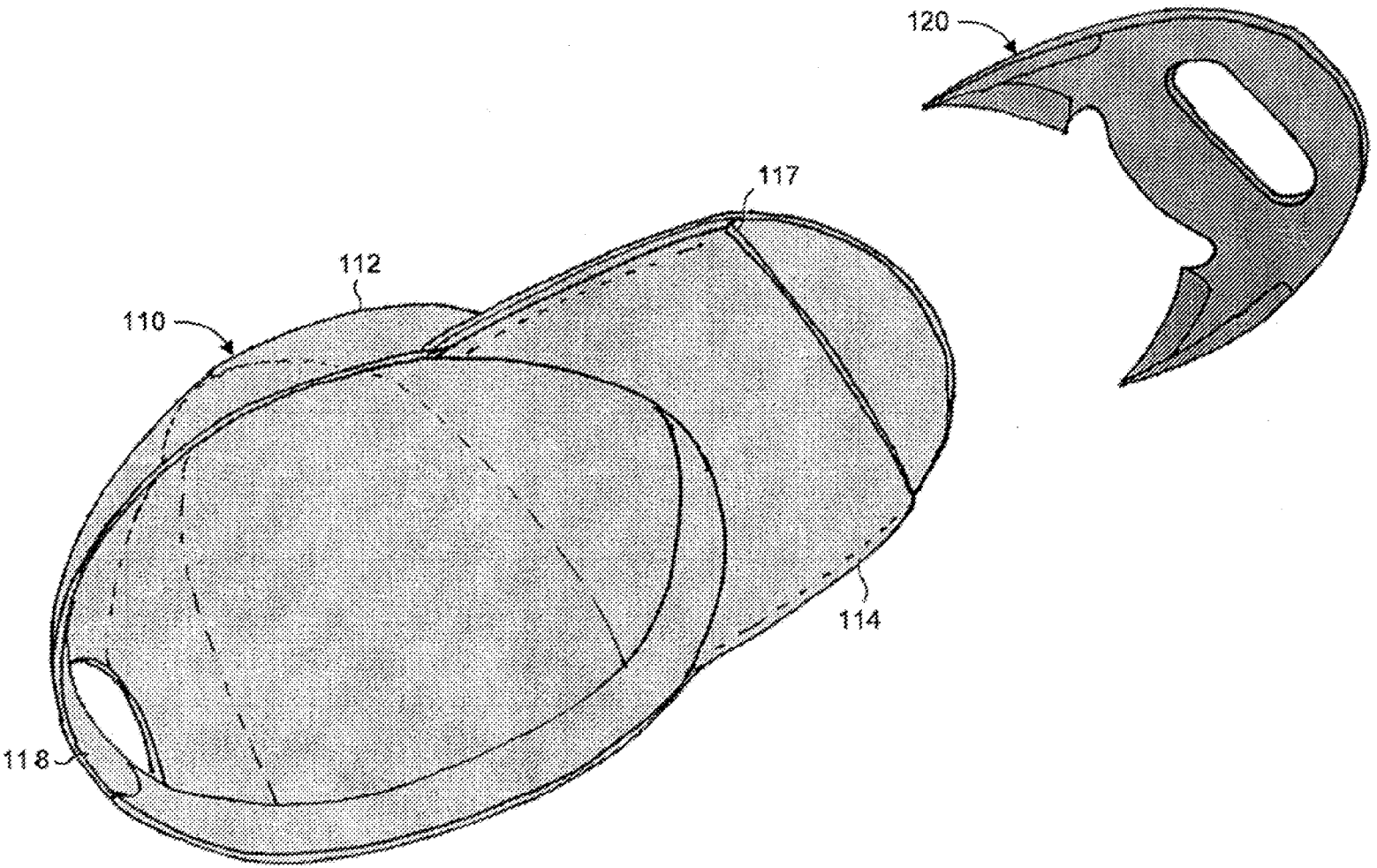
FIG. 3A is a bottom view schematic illustration of the weapon of FIG. 2 being concealed within the cap of FIGS. 1A and 1B, in accordance with an embodiment of the disclosed technique.
Figure 3B:
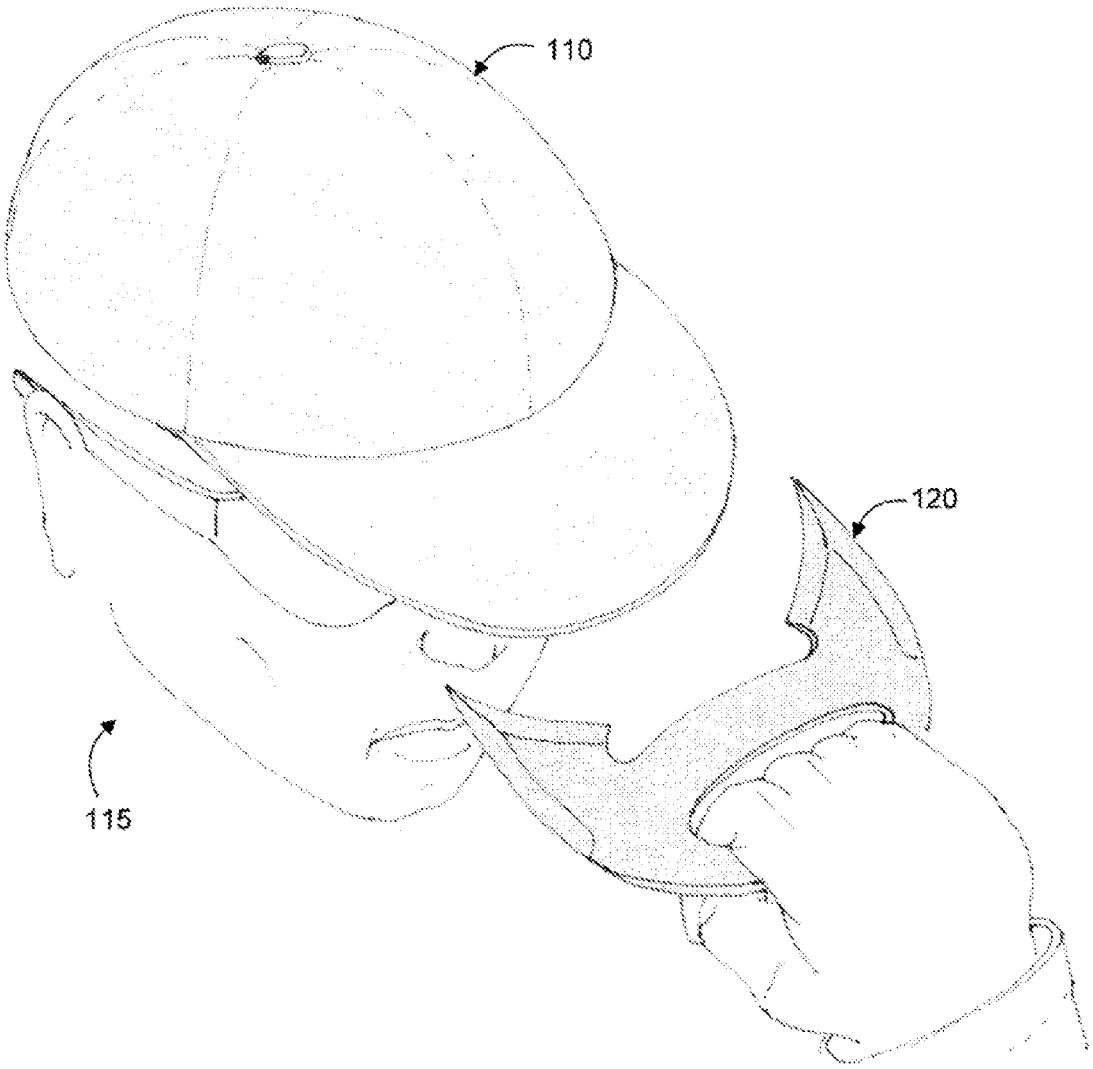
FIG. 3B is a front perspective view schematic illustration of a user wearing the cap of FIG. 3A and withdrawing from the cap the concealed weapon, in accordance with an embodiment of the disclosed technique.

Reference is now made to FIGS. 1A, 1B, 2, 3A and 3B. FIG. 1A is a bottom perspective view schematic illustration of a cap, generally referenced 110, for securely retaining and concealing a weapon, constructed and operative in accordance with an embodiment of the disclosed technique. FIG. 1B is a top perspective view schematic illustration of the cap (110) of FIG. 1A. FIG. 2 is a top perspective view schematic illustration of a weapon, generally referenced 120, adapted to be retained and concealed within the cap (110) of FIGS. 1A and 1B, constructed and operative in accordance with an embodiment of the disclosed technique. FIG. 3A is a bottom view schematic illustration of the weapon (120) of FIG. 2 being concealed within the cap (110) of FIGS. 1A and 1B, in accordance with an embodiment of the disclosed technique. FIG. 3B is a front perspective view schematic illustration of a user, referenced 115, wearing the cap (110) of FIG. 3A and withdrawing from the cap (110) the concealed weapon (120), in accordance with an embodiment of the disclosed technique.

Cap 110 is depicted as a standard baseball cap, with a dome-shaped crown section 112 that is positioned on top of the head of the person 115 wearing the cap 110, and a short brim 114 that protrudes from the front end of crown 112. The crown 112 is typically formed from six individual segments that are sewn or stitched together, with a button 116 at the apex of the crown dome joining all the segments together. Crown 112 and brim 114 are usually covered in fabric, such as cotton, wool, polyester, and the like. Portions of crown 112 may include holes or apertures, such as by means of a mesh webbing, to provide ventilation. Brim 114 typically has a circular perimeter, although may have alternative shapes or forms (e.g., substantially rectangular shaped). Cap 110 may include text or images, such as a team logo, embroidered onto a certain area (e.g., at the front of crown 112). The lower edge of cap 110 may include an elastic lining to enable the cap to be fitted onto different sized heads (e.g., "one size fits all"). Cap 110 may include a size-adjustment mechanism, such as an adjustable strap 118 at the rear end of crown 112, that enables the diameter of crown 112 to be enlarged or reduced. Alternatively, cap 110 may be a fixed size (e.g., small, medium, large). Cap 110 may generally be from any suitable material, in any suitable shape, size and style. Cap 110 may also be worn by a person 115 in a non-traditional manner, such as with the brim 114 facing the back or side of the person 115 (rather than the front).

Referring now to FIG. 2, weapon 120 has a general outline that resembles a crescent shape. Weapon 120 includes an arc-shaped rear edge 122, arc-shaped side edges 124 and 126, and an arc-shaped front edge 128. Rear edge 122 and side edges 124 and 126 are shaped to fit fully inside the circular perimeter of the brim 114 of cap 110. Weapon 120 further includes a central gap 130, a hand grip portion 132, a pair of blades 134A and 134B, a pair of trap inlets 136A and 136B, and a pressure focusing point 138. Central gap 130 is sized to comfortably allow simultaneous insertion of the fingers, allowing the user to securely grip weapon 120 with his palm positioned over hand grip portion 132 employing a partially clenched gripping motion, as depicted in FIG. 3B. Blades 134A and 134B project outwards from the right side and left side, respectively, of the front edge 128. Blades 134A, 134B have sharp inner edges, useful for cutting or slicing maneuvers when attacking an opponent. Blades 134A, 134B also have sharpened tips, useful for puncturing or stabbing maneuvers. Trap inlets 136A and 136B are small crescent-shaped indentations situated on the inner corners of respective blades 134A and 134B, and are intended to ensnare within it the weapon of the attacker. For example, if the assailant is wielding a knife (or similar handheld weapon), the user of weapon 120 may maneuver the front edge 128 toward the knife such that the knife becomes wedged inside one of the trap inlets 136A, 136B, e.g., by executing a rapid twisting motion against the knife. The user may then deflect the knife away from the assailant or force the assailant to drop the knife, or otherwise immobilize the knife from being utilized to attack the user. Pressure focusing point 138 is a short protrusion at substantially the center of front edge 128 of weapon 120. Pressure focusing point 138 is employed to provide additional impact when forcefully striking the assailant with the front edge 128 of weapon 120, and/or to direct the strike against a particular body region.

It is noted that the flat surface and/or arced edges of weapon 120 may also be utilized to shield and or deflect away an assailant's weapon, as well as providing structural integrity to weapon 120. In addition, the general form of blades 134A and 134B (e.g., the thicker fin-shaped central spine portion) serves to provide enhanced structural strength and ability to withstand applied stress, fracture, bending, deformation, and the like. Furthermore, the hand gripping feature of weapon 120 (using central gap 130 and hand grip portion 132) ensures that the user comfortably and securely holds on to weapon 120 and can wield weapon 120 comfortably and naturally while protecting his/her hand, and making it relatively difficult for weapon 120 to be dropped or be extracted by the assailant. It is further noted that weapon 120 is typically substantially small (e.g., 3-16 cm. in diameter) and lightweight (e.g., approximately 15-50 grams), enabling it to be wielded by the user swiftly and with ease (i.e., in comparison to larger and heavier weapons), while still having the potential to inflict significant harm and provide adequate self-defense. The small dimensions and low weight of weapon 120 also reduces stress and discomfort for the wearer's body (particularly on the head and neck) while the weapon is retained within cap 110. Weapon 120 may generally be utilized for attacking maneuvers and/or defensive maneuvers, although it should be noted that the design of weapon 120 is intended primarily to provide effective self-defense. For example, blades 134A and 134B are relatively short in length in order to not cause too severe of an injury to an opponent. More generally, weapon 120 is preferably intended to merely disable the opponent and protect the user (and others) from harm, rather than causing serious and irreparable harm or injury.

According to an embodiment of the disclosed technique, weapon 120 is concealed inside an interior pocket of cap 110. Referring now to FIG. 3A, weapon is placed inside a pocket 117 that is stitched onto the brim 114 of cap 110. Pocket 117 may be an inner lining that is situated somewhere between the outer surfaces of brim 114, such as a sheet of fabric that is sewn underneath a polypropylene-based board (or similar rigid segment) that forms the basis of brim 114. Pocket 117 is generally formed in such a manner that it appears integral to the regular structure and design of cap 110, such that cap 110 does not appear in any way abnormal, e.g., so that the very existence of pocket and/or the presence of a weapon situated within pocket, is not apparent upon a typical viewing of cap 110 (e.g., without performing a thorough inspection thereof). For example, pocket 117 is layered within cap 110 so that weapon 120 does not form a visible outline against the upper or lower surfaces of brim 114 which would be discernable by another individual and thereby reveal the presence of weapon 120.

Referring now to FIG. 3B, a user 115 who is wearing the weapon-concealing cap 110 deploys weapon 120 for use (e.g., when faced with circumstances requiring self-defense) by gripping weapon 120 via central gap 130 and hand grip portion 132 and then pulling outwards (i.e., toward the front in the direction away from cap brim 114), thus withdrawing weapon 120 from within pocket 117. After use, weapon 120 may be returned to cap 110 by simply sliding weapon 120 back inside pocket 117 in a similar manner.

Figure 4A:
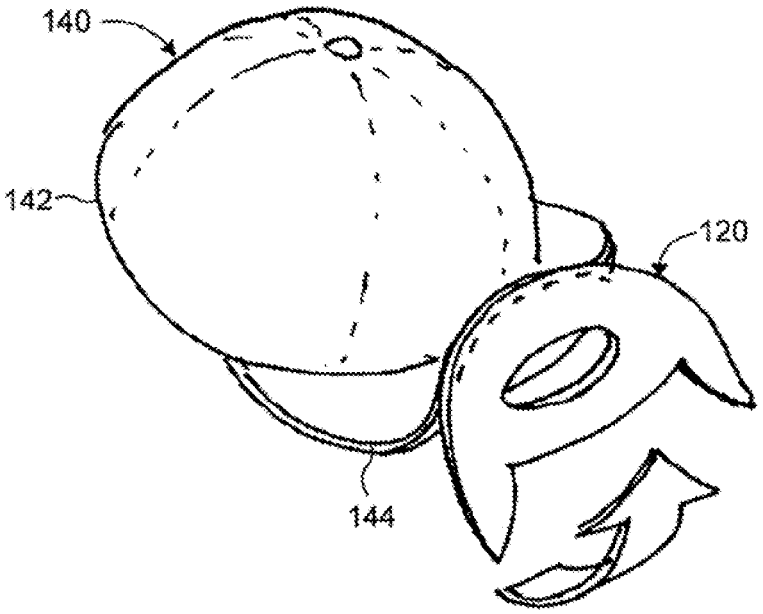
FIG. 4A is a front perspective view schematic illustration of a wearable weapon assembly in which the weapon is integrated together with the cap brim, constructed and operative in accordance with an embodiment of the disclosed technique.
Figure 4B:
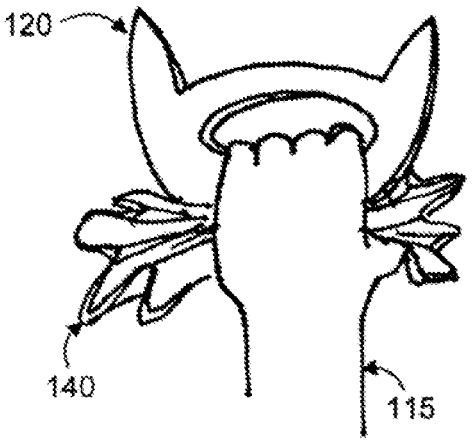
FIG. 4B is a top view perspective schematic illustration of the wearable weapon assembly of FIG. 4A with the weapon being deployed in a fully exposed manner.
Figure 4C:
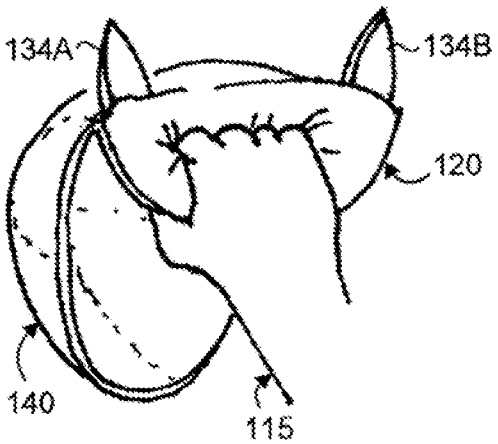
FIG. 4C is a top view perspective schematic illustration of the wearable weapon assembly of FIG. 4A with the weapon being deployed in a partially exposed manner.

According to other embodiments of the disclosed technique, weapon 120 is concealed within cap in a different manner (rather than within an interior pocket situated in the cap brim). For example, weapon 120 may be integrally formed together with the cap brim. Reference is now made to FIGS. 4A, 4B and 4C. FIG. 4A is a front perspective view schematic illustration of a wearable weapon assembly in which the weapon (120) is integrated together with the brim 144 of the cap, generally referenced 140, constructed and operative in accordance with an embodiment of the disclosed technique. FIG. 4B is a top view perspective schematic illustration of the wearable weapon assembly of FIG. 4A with the weapon (120) being deployed in a fully exposed manner. FIG. 4C is a top view perspective schematic illustration of the wearable weapon assembly of FIG. 4A with the weapon (120) being deployed in a partially exposed manner. Cap 140 is analogous to cap 110 (FIGS. 1A and 1B) except that weapon 120 is integrally formed with the brim 144 of cap. For example, weapon 120 is fixedly attached (e.g., sewn) to at least a portion of the bottom surface of brim 144 in a manner that maintains the regular design on cap 144 (e.g., such that the rear and side edges (122, 124, 126) of weapon 120 do not extend beyond the outer edges of cap 140). Accordingly, the flat bottom surface of weapon 120 forms the bottom surface of the cap brim 144. Nonetheless, weapon 120 is still concealed within cap 140, since the bottom of brim 144 is generally not clearly visible to others.

The user 115 may deploy weapon 120 by removing cap 140 and then gripping weapon 120 in a manner suitable for use. For example, the user 115 may peel back a portion of brim 144 (i.e., a portion that is not directly sewn together with weapon 120) and insert his/her fingers through central gap 130 while crumpling the crown 142 and peeled back brim 144 portions of cap 140 and positioning his/her palm over the top surface of hand grip portion 132 of weapon 120 and over the crumpled portions of cap 140 (FIG. 4B). Consequently, weapon 120 is fully exposed, with the front edge 128 and blades 134A, 134B facing out toward the opponent, and ready for use. Alternatively, after removing cap 140, the user 115 may bend the crown 142 forward and then insert his/her fingers through central gap 130 while positioning his/her palm over the bottom surface of hand grip portion 132, leaving the majority of weapon 120 concealed behind the bended crown 142 while the blades 134A, 134B jut outwards (in full view) to be wielded against the opponent (FIG. 4C). When deploying weapon 120 in the partially exposed manner, cap 140 may also be employed as a type of weapon to attack the opponent, and cap 140 further serves to provide some protection to the user's hand.

Figure 5A:
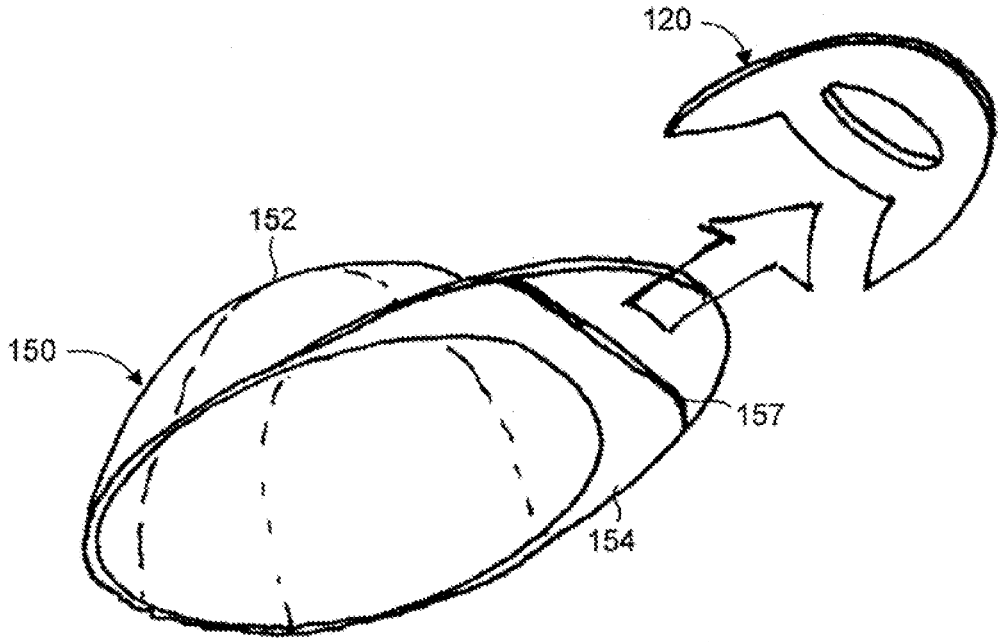
FIG. 5A is a bottom perspective view schematic illustration of a wearable weapon assembly in which the weapon is partially retained inside an interior pocket of the cap brim, constructed and operative in accordance with another embodiment of the disclosed technique.
Figure 5B:
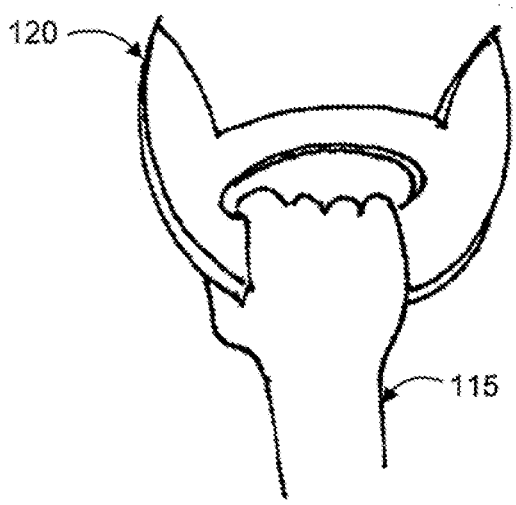
FIG. 5B is a top view schematic illustration of the weapon from the wearable weapon assembly of FIG. 5A being deployed.

Weapon 120 may alternatively be placed within an interior pocket of the cap brim in a manner where only a portion of the weapon is sheathed inside the pocket while the remainder of the weapon is unsheathed. Reference is now made to FIGS. 5A and 5B. FIG. 5A is a bottom perspective view schematic illustration of a wearable weapon assembly in which the weapon (120) is partially retained inside an interior pocket of the brim of the cap, generally referenced 150, constructed and operative in accordance with another embodiment of the disclosed technique. FIG. 5B is a top view schematic illustration of the weapon (120) from the wearable weapon assembly of FIG. 5A being deployed. Cap 150 is analogous to cap 110 (FIGS. 1A and 1B) except that weapon 120 is partially retained inside a pocket 157 that is stitched (or otherwise formed) in the brim 154 of cap 150. Pocket 157 may be an inner lining that is sewn at a particular layer between the outer surfaces of brim 154, but does not extend across the entire length of brim 154. Accordingly, when weapon 120 is inserted into pocket 157, the front portion of weapon 120 is sheathed (and fully concealed) inside pocket 157, while the rear portion (e.g., hand grip portion 132) is situated underneath the front edge of brim 154 but still concealed from view (i.e., since the rear and side edges 122, 124, 126 of weapon do not extend beyond the outer edges of brim 154). The user wearing cap 150 deploys weapon 120 for use by gripping weapon 120 (via central gap 130 and hand grip portion 132) and then pulling outwards away from brim, to withdrawn weapon 120 from within pocket 157 (FIG. 5B). After use, weapon 120 may be returned to cap 150 by simply sliding weapon 120 back inside pocket 157.

Figure 6A:
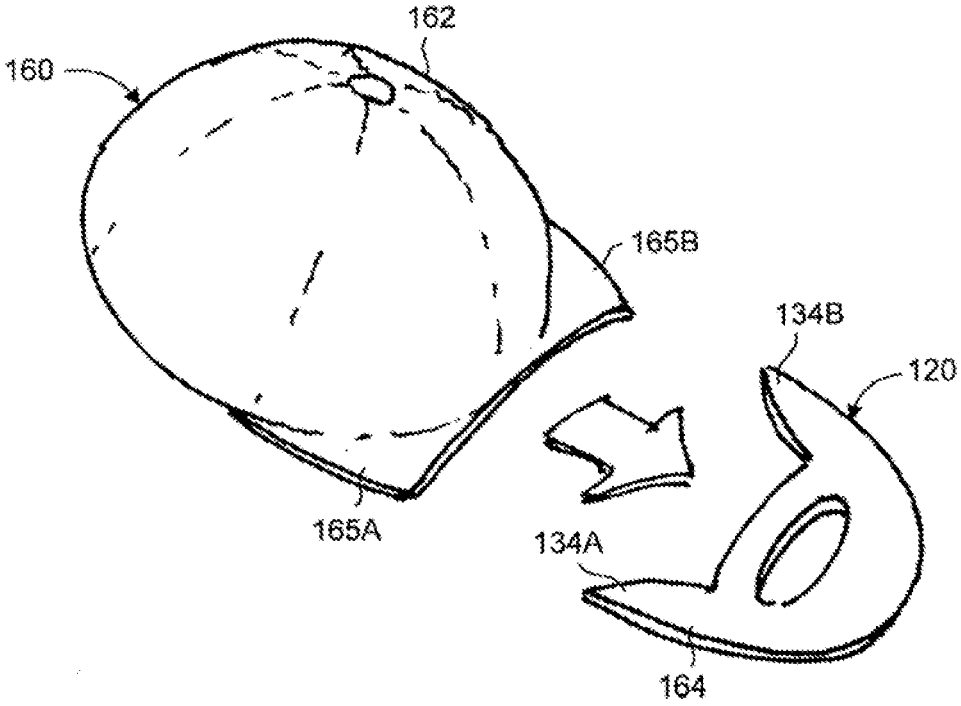
FIG. 6A is a top perspective view schematic illustration of a wearable weapon assembly in which the weapon forms a detachable cap brim, constructed and operative in accordance with a further embodiment of the disclosed technique.
Figure 6B:
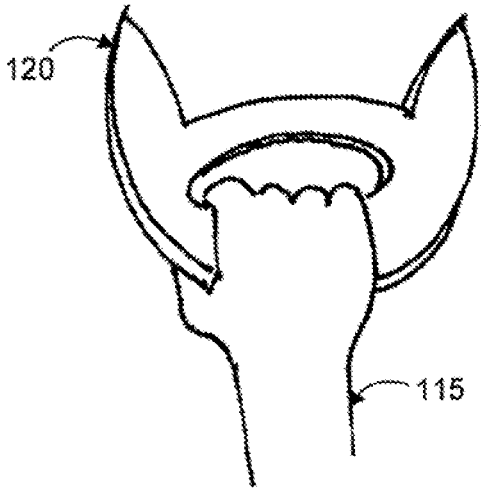
FIG. 6B is a top view schematic illustration of the weapon from the wearable weapon assembly of FIG. 6A being deployed.

Weapon 120 may further alternatively form an actual brim that is detachable from the rest of the cap. Reference is now made to FIGS. 6A and 6B. FIG. 6A is a top perspective view schematic illustration of a wearable weapon assembly in which the weapon (120) forms a detachable brim of the cap, generally referenced 160, constructed and operative in accordance with a further embodiment of the disclosed technique. FIG. 6B is a top view schematic illustration of the weapon (120) from the wearable weapon assembly of FIG. 6A being deployed. Cap 160 is analogous to cap 110 (FIGS. lA and 1B) except that weapon 120 forms the brim 164 of cap 160, and is detachable from the crown portion 162 of cap 160. Weapon

120 is removably attached to the crown 162, for example by at least one adhesive (e.g., buttons, clips, pins, snaps a zipper, Velcro® (i.e. hook and loop) fasteners, and the like) disposed on a portion of weapon 120 (e.g., on each of blades 134A, 134B) and/or disposed on a portion of cap 160 (e.g., on the bottom side edges of crown 162 or a segment of brim 164 affixed to crown 162). Alternatively, weapon 120 may be partially inserted into a pocket of cap 160 such that weapon 120 forms a brim 164 that is securely held by the pocket. For example, blades 134A, 134B are insertable into shallow pockets on each side of a brim segment (referenced 165A and 165B, respectively) that is fixedly attached to crown 162. Accordingly, weapon 120 is withdrawn from cap 160 by gripping weapon via central gap 130 and hand grip portion 132, unfastening any adhesives or fasteners if necessary, and pulling outwards (i.e., away from crown 162), to deploy weapon 120 for use (FIG. 6B). Weapon 120 may then be (removably) reattached to cap 160 as before (e.g., via the adhesive(s) or fastener(s), by inserting blades 134A, 134B into shallow pockets on brim segments 165A and 165B, and the like). When weapon 120 is attached to cap 160 (forming brim 164 thereof), it appears integral to the regular structure and design of cap 160, i.e., such that the ability of brim 164 to detach and to convert into a weapon 120 is not readily apparent upon a typical view of cap 160 (e.g., without being exceedingly near and/or performing a thorough inspection of cap 160).

Figure 7A:
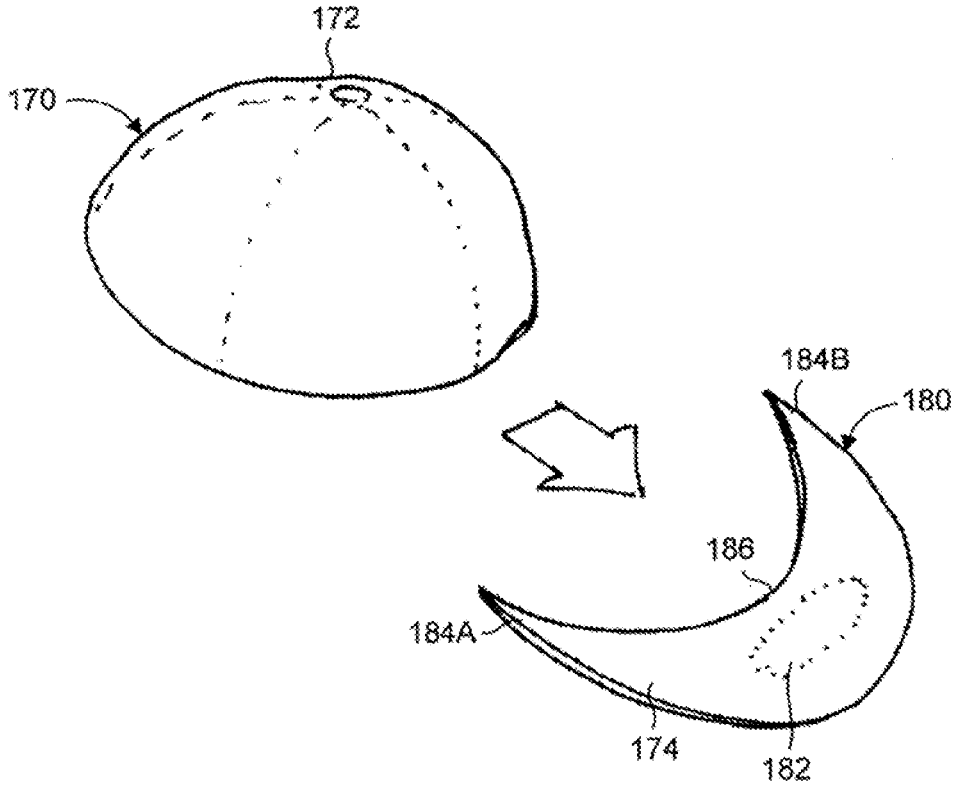
FIG. 7A is a top perspective view schematic illustration of a wearable weapon assembly with an alternatively shaped weapon that forms a detachable and fully integrated cap brim, constructed and operative in accordance with yet another embodiment of the disclosed technique.
Figure 7B:
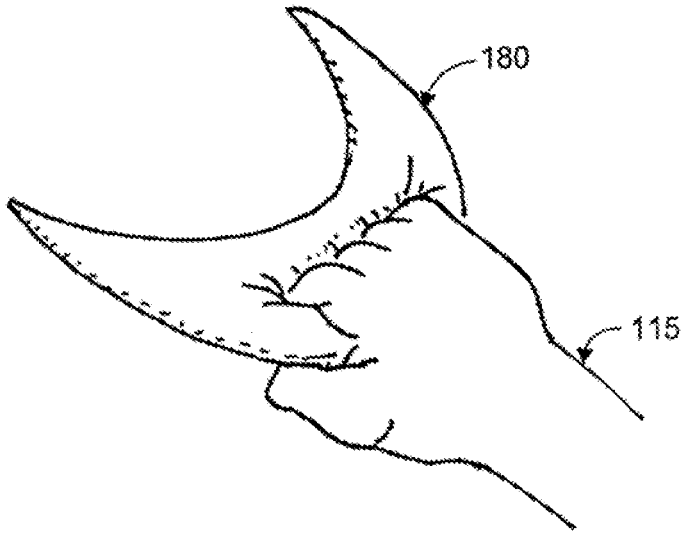
FIG. 7B is a top view perspective schematic illustration of the weapon from the wearable weapon assembly of FIG. 7A being deployed.

According to a further embodiment of the disclosed technique, the wearable weapon assembly includes a cap with a crown portion and a crescent-shaped weapon which resembles but is not identical to weapon 120 (FIG. 2) and which forms the brim that is detachable from the rest of cap (similar to cap 160 of FIG. 6A). Reference is now made to FIGS. 7A and 7B. FIG. 7A is a top perspective view schematic illustration of a wearable weapon assembly with an alternatively shaped weapon, generally referenced 180, that forms a detachable and fully integrated brim of the cap, generally referenced 170, constructed and operative in accordance with yet another embodiment of the disclosed technique. FIG. 7B is a top view perspective schematic illustration of the weapon from the wearable weapon assembly of FIG. 7A being deployed. Cap 170 includes a crown portion 172 (analogous to crown 112 of cap 110) and a brim portion 174 that is formed by a crescent-shaped weapon 180, and is detachable from the crown 172. Weapon 180 includes a central gap 182, through which the fingers of the user can be inserted in order to grip weapon 180 (similar to gap 130 of weapon 120). Weapon 180 further includes crescent peaks 184A and 184B on opposite sides, which have sharpened inner edges and a sharp tip that may be used for cutting, slicing or puncturing maneuvers, similar to blades 134A and 134B of weapon 120. Weapon 180 is removably attached to the crown 172, for example by at least one adhesive (e.g., buttons, clips, pins, snaps, a zipper, Velcro® (i.e. hook and loop) fasteners, and the like) disposed on a portion of weapon 180 (e.g., on each of crescent peaks 184A, 18B and/or on the front edge 186) and/or disposed on a portion of cap 170 (e.g., on the bottom and side edges of crown 172). Accordingly, weapon 180 is withdrawn from cap 170 by gripping weapon 180 via central gap 182, unfastening any adhesives or fasteners if necessary, and pulling outwards (i.e., away from crown 172), to deploy weapon 180 for use (FIG. 7B). Weapon 120 may be then be (removably) reattached to cap 170 as before (e.g., via the adhesive(s) or fastener(s)). Weapon 180 appears integral to the regular structure and design of cap 170 when attached thereto, and the ability of cap brim 174 to detach and to convert into a weapon 180 is not readily apparent to others upon a typical viewing of cap 170. As depicted in FIG. 7B, weapon 180 may include a covering, such as a homogenous layer of spandex or another suitable material. The covering serves to conceal the weapon features while weapon 180 is being retained within cap 172 and while weapon 180 is being deployed. When withdrawing or deploying weapon 180, the covering material stretches to reveal the central gap 182, enabling the user to grip weapon 180. It is noted that any weapon of the disclosed technique may include such a covering (e.g., not limited to a weapon that forms a detachable and fully integrated cap brim).

Figure 8:
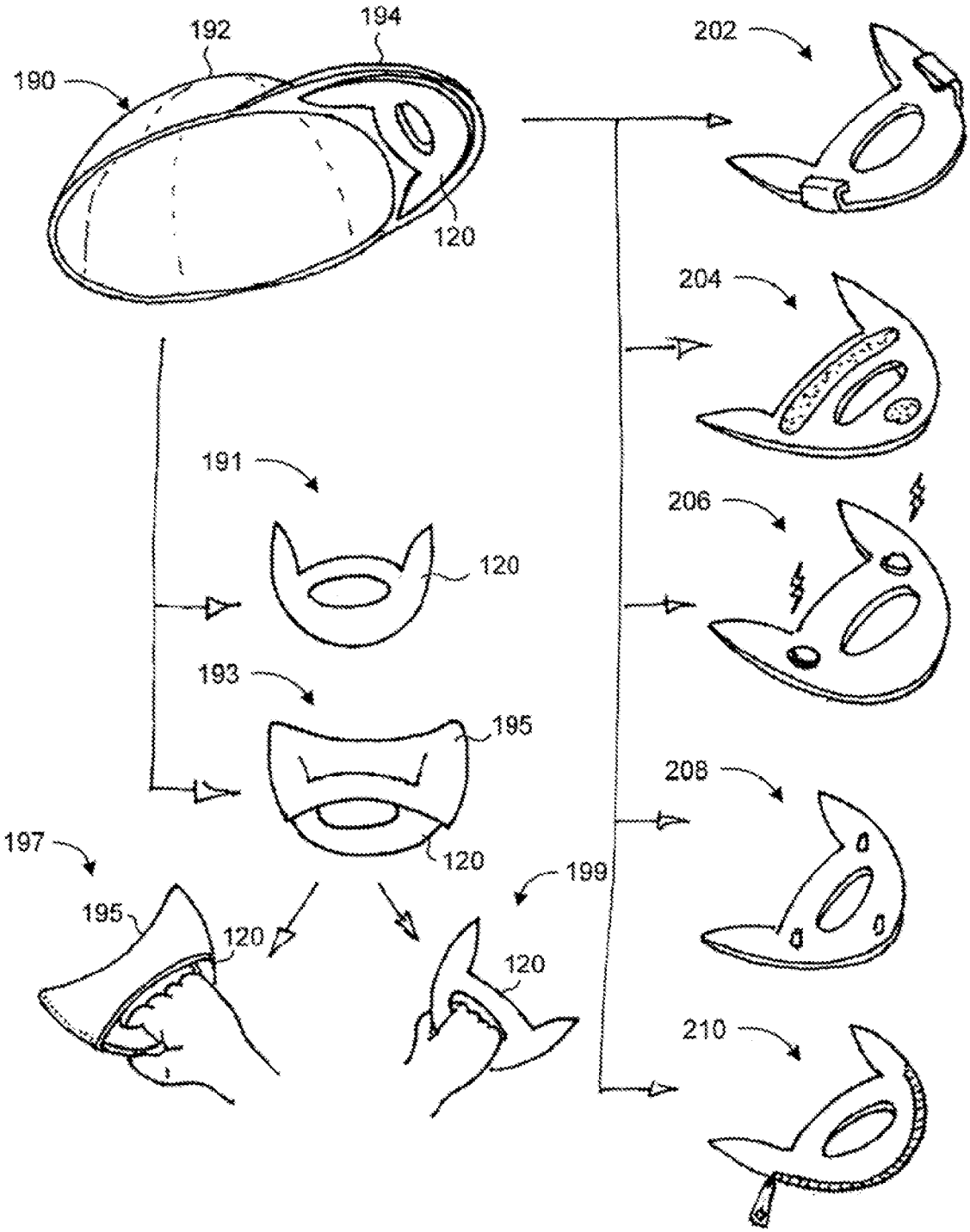
FIG. 8 is a schematic illustration depicting various fastener types and other supplementary components for a wearable weapon assembly, constructed and operative in accordance with yet another embodiment of the disclosed technique.

Reference is now made to FIG. 8, which is a schematic illustration depicting various fastener types and other supplementary components for a wearable weapon assembly, constructed and operative in accordance with yet another embodiment of the disclosed technique. Cap 190 is analogous to cap 110 (FIGS. 1A and 1B) except that weapon 120 is removably affixed to the bottom surface of the brim 194 of cap 190, via at least one fastener. For example, the weapon may be fastened using clips (depicted in reference 202), using a Velcro® (i.e. hook and loop) fastener (depicted in reference 204), using magnets (depicted in reference 206), using mechanical fasteners such as buttons, pins, snaps and the like (depicted in reference 208), and/or using a zipper (depicted in reference 210). Alternative types of fasteners are also within the scope of the disclosed technique. The fastener may be disposed on a portion of the weapon 120 (as shown), or on the bottom surface of brim 194, or further alternatively there may be a corresponding fastener component disposed on the bottom surface of brim 194 that is adapted to mate with a fastener component disposed on the weapon (e.g., corresponding strips of Velcro® "hook and loop" fasteners on each surface). Weapon 120 is affixed to the bottom of brim 194 in such a manner that maintains the regular design of cap, and such that weapon 120 is not readily apparent upon a typical viewing of cap 190 (e.g., such that the rear and side edges (122, 124, 126) of weapon 120 do not extend beyond the outer edges of cap 190).

Weapon 120 may be fastened to the bottom of the brim 194 of cap 190 together with a weapon sheath 195 (depicted in reference 193), or alone without a weapon sheath (depicted in reference 191). Weapon sheath 195 may serve to protect weapon 120 from deterioration (e.g., exposure to the elements, such as rain or heat), and to further aid in concealing weapon 120. Weapon sheath 195 may be made from any suitable material, but preferably from a rigid fabric or material, such as leather or plastic. Weapon sheath 195 is shaped to comfortably match the contour of weapon 120. A fastener (such as any of the fasteners shown in 202, 204, 206, 208, 210) may be disposed directly on weapon sheath 195 for affixing sheath 195 to the bottom surface of brim 194, after which weapon 192 is inserted into sheath 195. Weapon sheath 195 may be fixedly fastened onto the bottom of brim 194, such that only weapon 120 is withdrawn from sheath during use. Alternatively, weapon sheath 195 may be removably fastened onto the bottom of brim 194, such that weapon 120 is withdrawn together with weapon sheath 195. If weapon sheath 195 is withdrawn as well, then weapon 120 may be deployed for use while still sheathed within weapon sheath 195 (as depicted in reference 197), or alternatively, weapon 120 may be removed from sheath 195 and only then deployed for use (as depicted in reference 199). Deploying weapon 120 while still sheathed within weapon sheath 195 also ensures that minimal harm or injury is sustained by the opponent.

Figure 9:
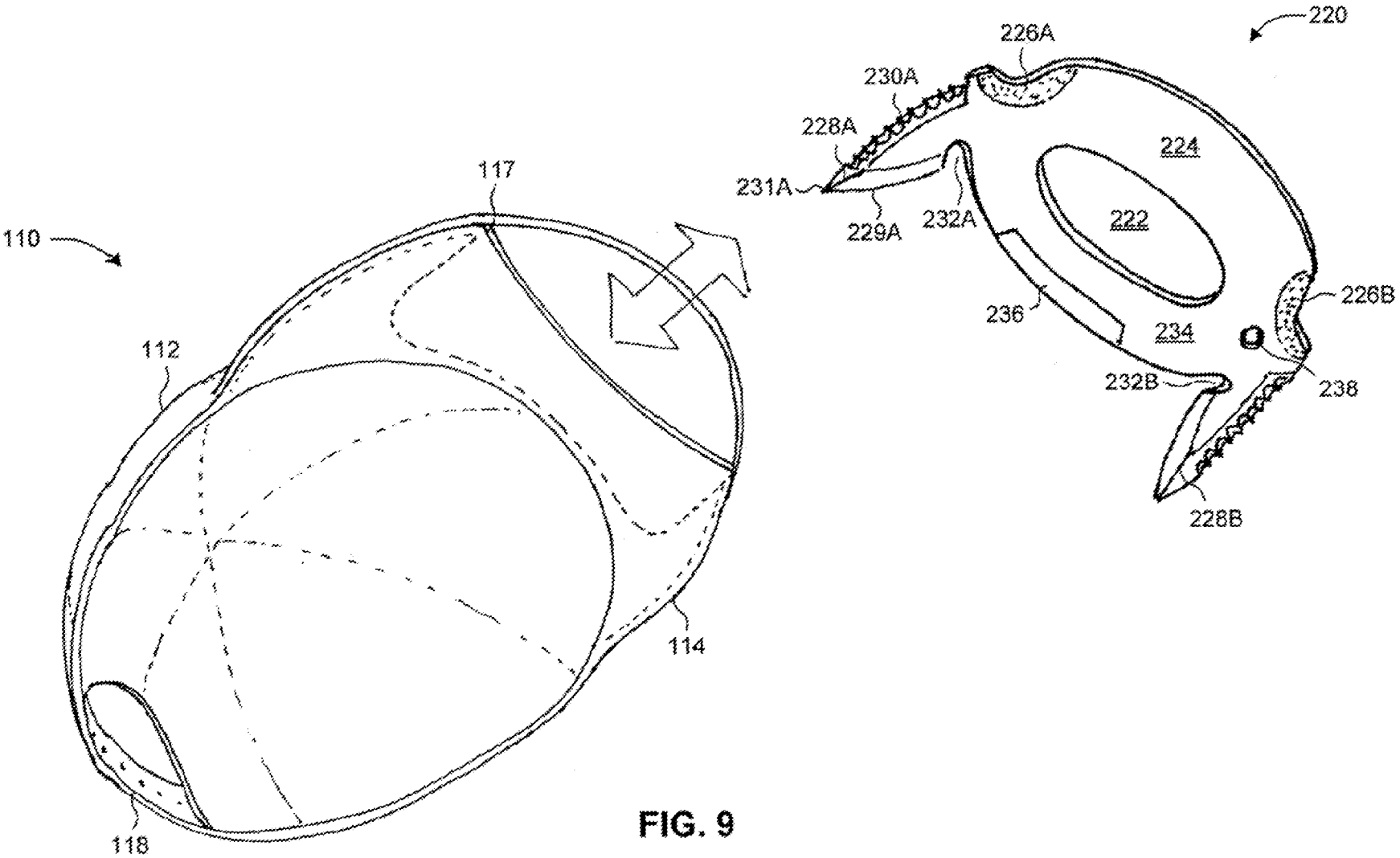
FIG. 9 is a bottom perspective view schematic illustration of a weapon, which is a variation of the weapon of FIG. 2, and is adapted to be retained and concealed within a cap, constructed and operative in accordance with another embodiment of the disclosed technique.

Reference is now made to FIG. 9, which is a bottom perspective view schematic illustration of a weapon, generally referenced 220, which is a variation of the weapon (120) of FIG. 2, and is adapted to be retained and concealed within a cap, constructed and operative in accordance with another embodiment of the disclosed technique. Weapon 220 is retained and concealed within a pocket 117 situated in the brim 114 of cap 110 (similar to weapon 120 of FIG. 2 and cap 110 of FIGS. 1A and 1B). Weapon 220 is generally crescent-shaped, and includes a central gap 222, a hand grip portion 224, a pair of thumb rests 226A and 226B, a pair of side blades 228A and 228B, a pair of trap inlets 232A and 232B, a finger protection portion 234, a frontal blade 236, and a lanyard hole 238. Central gap 222 and hand grip portion 224 are respectively analogous to central gap 130 and hand grip portion 132 (weapon 120), for allowing the user to insert his/her fingers through gap 222 and securely grip weapon 220 with his/her palm positioned over hand grip portion 224 with a partially clenched gripping motion. While gripping weapon 220, the user can position his/her thumb against thumb rest 226A or thumb rest 226B (depending on whether the user is right-handed or left-handed), for increased support and a more comfortable grip. The user may also attack the opponent with the respective thumb rest 226A or 226B that does not have his/her thumb positioned against it (e.g., by striking with the short protrusion between the front edge of the thumb rest (226A, 226B) and the rear edge of the respective side blade (228A, 228B)). Side blades 228A, 228B are similar to blades 134A, 134B (weapon 120), also having a sharp smooth inner blade edge 229A, 229B and a sharp tip 231A, 231B, but with the addition of a serrated outer blade edge 230A, 230B. Serrated edges 230A, 230B can be utilized for cutting in a serrated manner, as an alternative to smooth cutting provided by smooth edges 229A, 229B (serrated cutting is generally quicker but less cleaner and less precise than smooth cutting, and also provides multiple entry points into the surface being cut). For example, serrated edges 230A, 230B may be used for quick cutting of a garment, a bandage, and the like. Sharp tips 231A, 231B can be utilized for puncturing or stabbing maneuvers. Trap inlets 232A, 232B are analogous to trap inlets 136A, 136B (weapon 120), for ensnaring or deflecting away a weapon of the assailant (e.g., wedging a knife inside one of inlets 232A, 232B). Finger protection portion 234 provides shielding for the user's fingers (i.e., inserted through gap 222 while gripping weapon 220) as weapon 220 is being wielded. Front blade 236 is another sharp edge at the front of weapon 220, to provide additional cutting or slicing maneuverability when striking an assailant with the front edge of weapon 220. Front blade 236 may also be used for cutting other items (e.g., a rope) if required. A lanyard, such as a cord or string, may be inserted through lanyard hole 238, allowing weapon 220 to be secured to the user while being wielded, such as by fastening the lanyard around the hand or wrist. Weapon 220 may also be worn or carried via the lanyard (e.g., around the neck), for example when it is no longer necessary or desirable to conceal the weapon. The lanyard may additionally be utilized to withdraw weapon 220 from cap brim 114 (i.e., by pulling on the lanyard, which may be more easily accessible to the user when weapon 220 is retained within cap brim 114).

As depicted in FIG. 9, cap 110 may have a reinforced brim (shown by dashed lines in Figure), such as by being formed with multiple layers and/or a thicker lining, to reinforce and provide added support for cap 110 in general, and particularly for supporting brim 114 when a weapon is retained therein (e.g., within pocket 117) in accordance with the disclosed technique.

Figure 10:
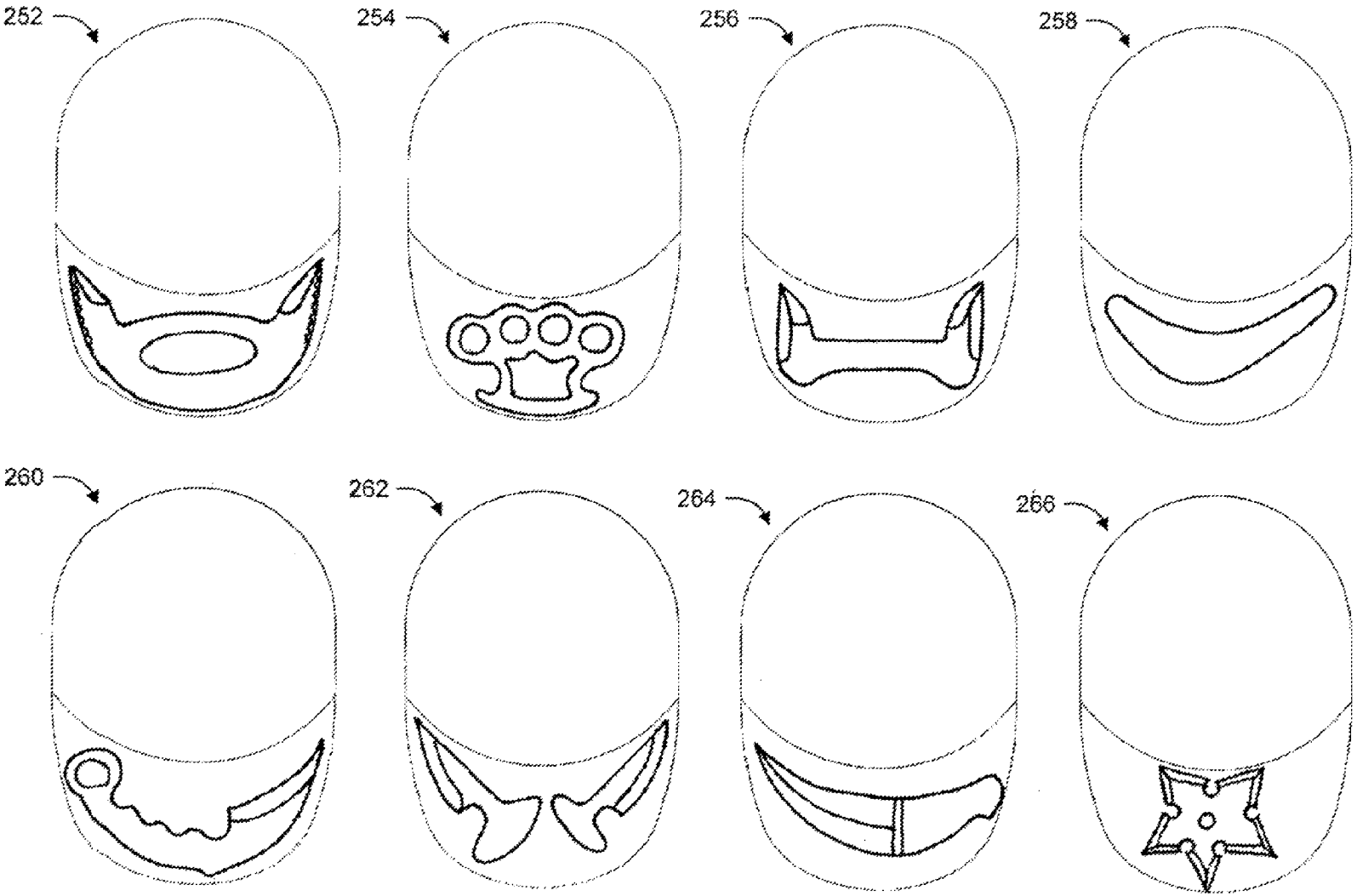
FIG. 10 is a schematic illustration of exemplary varieties of weapons which can be used in conjunction with the wearable weapon assembly of the disclosed technique.

It is appreciated that each of the aforementioned features of weapon 220 are optional, and may be included or omitted from alternative weapons to be used in accordance with the disclosed technique. More generally, weapons 120 and 220 each represent an exemplary design and configuration of a weapon to be used in accordance with the disclosed technique. The disclosed technique is more generally applicable to any type of weapon which is sized and shaped to fit entirely within the brim of a cap, namely, such that the cap does not appear abnormal or unusual and such that the presence of the weapon is not readily apparent upon a typical viewing of the cap. For example, the weapon should be sized and shaped to fit fully inside the perimeter of the brim. Reference is now made to FIG. 10, which is a schematic illustration of exemplary varieties of weapons which can be used in conjunction with the wearable weapon assembly of the disclosed technique. Exemplary weapons include: a crescent-shaped weapon similar to weapons 120 and 220 (depicted in reference 252), brass knuckles (depicted in reference 254), a double bladed knife (depicted in reference 256), a boomerang weapon (depicted in reference 258), a karambit (depicted in reference 260), a push dagger (depicted in reference 262), a knife (depicted in reference 264), and a hira-shuriken, also known as a "throwing star" or "ninja star" (depicted in reference 266). It is appreciated that a plurality of such weapons, including combinations of different weapon types, may also be retained and concealed within a cap in accordance with the disclosed technique, provided that all the weapons are jointly sized and shaped to fit together fully within the perimeter of the cap brim (or to form the cap brim), as discussed hereinabove. In addition, the weapon(s) retained and concealed within the cap should not be too heavy that it disturbs the person wearing the cap, namely, it should not feel cumbersome or uncomfortable when wearing the cap.

A weapon used in accordance with the disclosed technique may be composed, in part or in whole, from any suitable material, such as plastics, metals (e.g., titanium), composite materials, and the like. It is noted that if the weapon is made entirely of plastic (or other non-metallic materials), there is the added benefit of being able to evade metal detectors, and thus ensure concealment when the user is at a location where metal detectors are utilized. If the weapon is composed of a water-resistant material (such as plastic), the weapon may be utilized effectively when the user is in a wet environment (e.g., while raining or snowing, at a swimming pool or beach, and the like). It is further noted that the use of composite materials or polymers facilitates the customizing of various physical attributes of the weapon (e.g., strength, sharpness, and the like).

Figure 11:
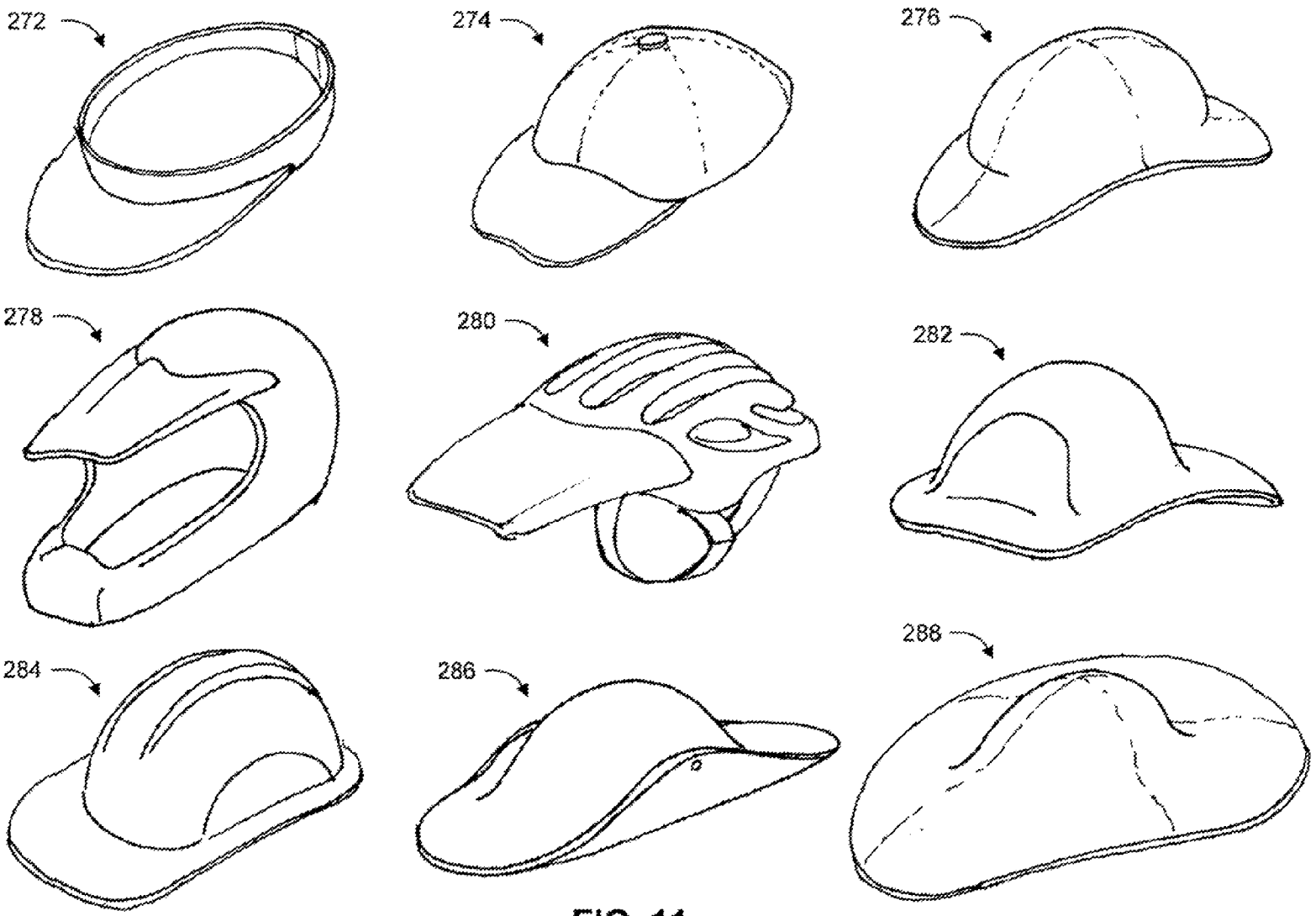
FIG. 11 is a schematic illustration of exemplary varieties of wearable headgear which can be used in conjunction with the wearable weapon assembly of the disclosed technique.

In addition, the disclosed technique is more generally applicable to any type of wearable headgear which includes a brim portion that is sized and shaped to retain and conceal a weapon, such as inside an interior pocket situated within the brim (as with cap 110). Reference is now made to FIG. 11, which is a schematic illustration of exemplary varieties of wearable headgear which can be used in conjunction with the wearable weapon assembly of the disclosed technique. Exemplary headgear include: an open-top visor (depicted in reference 272), a baseball cap, similar to cap 110 of FIGS. 1A and 1B (depicted in reference 274), a double brimmed hat (depicted in reference 276), a motorcycle helmet (depicted in reference 278), a bicycle helmet (depicted in reference 280), a firefighter helmet (depicted in reference 282), a construction helmet or hard hat (depicted in reference 284), a cowboy hat (depicted in reference 286), and a sun hat or sombrero (depicted in reference 288). It is noted that a double brimmed hat (reference 276) may retain a separate weapon on each brim. It is appreciated that even if an individual is positioned close enough to obtain an unobstructed view from underneath the wearable headgear, it would still be difficult to recognize the presence of a weapon that is retained and concealed within the wearable headgear in accordance with the disclosed technique, e.g., due to various shapes and shadows and other features that would not be clearly discernable to the individual.

Figure 12A:
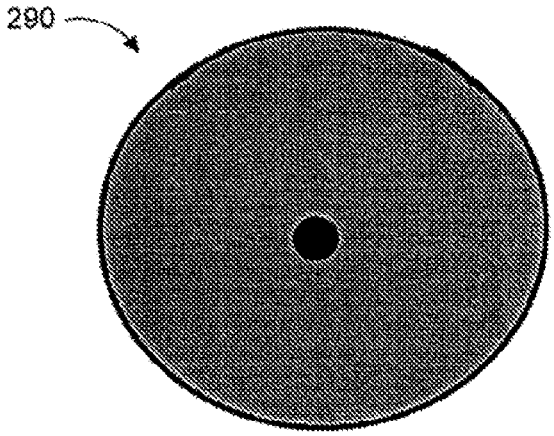
FIG. 12A is a top view schematic illustration of a yarmulke for securely retaining and concealing a weapon, constructed and operative in accordance with an embodiment of the disclosed technique.
Figure 12B:
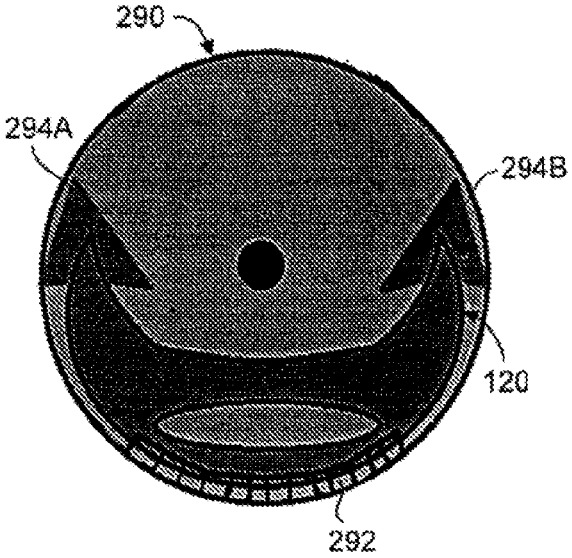
FIG. 12B is a top view schematic illustration of a weapon retained and concealed within the yarmulke of FIG. 12A, constructed and operative in accordance with an embodiment of the disclosed technique.
Figure 12C:
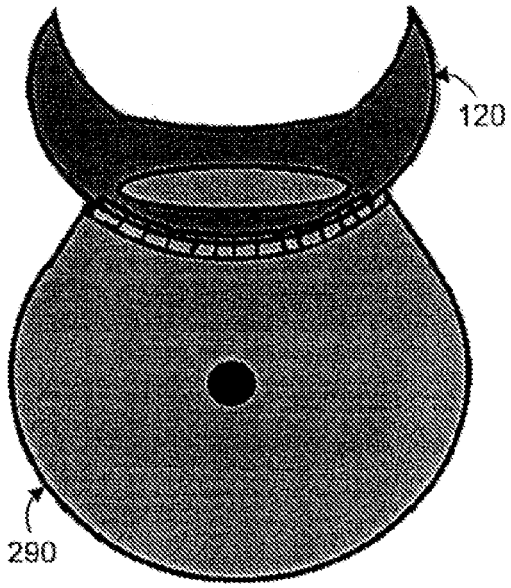
FIG. 12C is a top view schematic illustration of the weapon of FIG. 12B being deployed, constructed and operative in accordance with an embodiment of the disclosed technique.

Other exemplary headgear that do not typically include a brim portion may also be specifically designed to incorporate a region for retaining and concealing a weapon in accordance with the disclosed technique, for example, by forming an interior pocket in the underside of the head-covering section which is shaped and sized such that a weapon can be retained and concealed therein. Reference is now made to FIGS. 12A, 12B and 12C. FIG. 12A is a top view schematic illustration of a yarmulke, generally referenced 290, for securely retaining and concealing a weapon, constructed and operative in accordance with an embodiment of the disclosed technique. FIG. 12B is a top view schematic illustration of a weapon (120) retained and concealed within the yarmulke (290) of FIG. 12A, constructed and operative in accordance with an embodiment of the disclosed technique. FIG. 12C is a top view schematic illustration of the weapon (120) of FIG. 12B being deployed, constructed and operative in accordance with an embodiment of the disclosed technique. Yarmulke 290 is generally circular in shape, and the entirety of yarmulke 290 is disposed on the head of the wearer (i.e., yarmulke 290 can be considered as having only a crown portion and no brim portion). Yarmulke 290 includes a fastener 292 and two small pockets 294A and 294B. Fastener 292 is disposed at a front edge of yarmulke 290, and may be for example a Velcro® (i.e. hook and loop) fastener, and is operative to removably fasten the rear edge (122) of weapon 120 at the front edge of yarmulke 290. Alternatively, the rear edge of weapon 120 may be fixedly fastened at the front edge of yarmulke 290 (e.g., by being stitched or sewn thereto). Pockets 294A and 294B are triangular-shaped and situated on opposite side edges of yarmulke 290. Pockets 294A and 294B may alternatively be shaped differently, be situated at different locations, and yarmulke 290 may include any number of pockets. The ends of each blade (134A, 134B) of weapon are inserted into respective pockets 294A and 294B, such that weapon 120 is retained underneath yarmulke 290 via fastener 292 and pockets 294A, 294B. Weapon 120 is fully retained within the perimeter of yarmulke 290, such that weapon 120 is concealed from others (i.e., the entire weapon 120 is situated over the head of the wearer and underneath the yarmulke 290).

The user may deploy weapon 120 by removing yarmulke 290 from the head, pulling the blade ends out from pockets 294A and 294B, unfastening the rear edge from fastener 292, and gripping weapon 120 via the hand grip. Alternatively, the user may keep the rear edge of weapon 120 fastened to yarmulke 290 (e.g., if fixedly fastened thereto), and then bend back the yarmulke 290 while gripping the weapon 120 (e.g., inserting his/her fingers through central gap 130 and positioning his/her palm over hand grip portion 132 and over the bent yarmulke 290), thereby deploying weapon 120 for use together with yarmulke 290 (FIG. 12C).

It is noted that withdrawing a weapon that is retained and concealed within a headgear worn on the head is quicker than if the weapon were retained at other regions of the body, such as behind a belt or a lower pant leg, providing speedier reaction and weapon deployment and thus an improved ability to defend oneself against an assailant. Furthermore, it is a natural instinct for a person to raise his/her hands toward his/her head during a confrontational situation, resulting in convenient and intuitive access to the retained weapon. In addition, a person may be compelled to raise his/her hands in a confrontational situation (e.g., being requested by a potential assailant to place his/her hands in the air to demonstrate a lack of weapons), which would then allow the person to quickly withdraw and deploy the weapon that is retained and concealed in his wearable headgear, thus taking the potential assailant by surprise. It is further noted that a weapon of a wearable weapon assembly according to the disclosed technique may be employed for any suitable task or purpose (e.g., as a working tool), and is not limited to self-defense use.

It is further noted that a headgear can be worn in conjunction with a lack of other type of garments, for example, when wearing only a bathing suit, providing the opportunity to carry the concealed weapon in such situations (e.g., when at a swimming pool or at the beach). In addition, the wearable weapon assembly of the disclosed technique provides all the uses and advantages of an ordinary headgear, such as protection from the sun, wind or rain. The wearable weapon assembly of the disclosed technique may be supplied to a plurality of individuals in a particular group, for example a group of people that have similar attire (e.g., a team of security guards obliged to wear a common uniform), which would serve to further disguise the location (and the very existence) of the weapon. The wearable weapon assembly of the disclosed technique may generally be utilized against any type or number of assailants, including people, animals, or any living creature (e.g., defending oneself against a hostile dog, or a shark attack).

Figure 13:
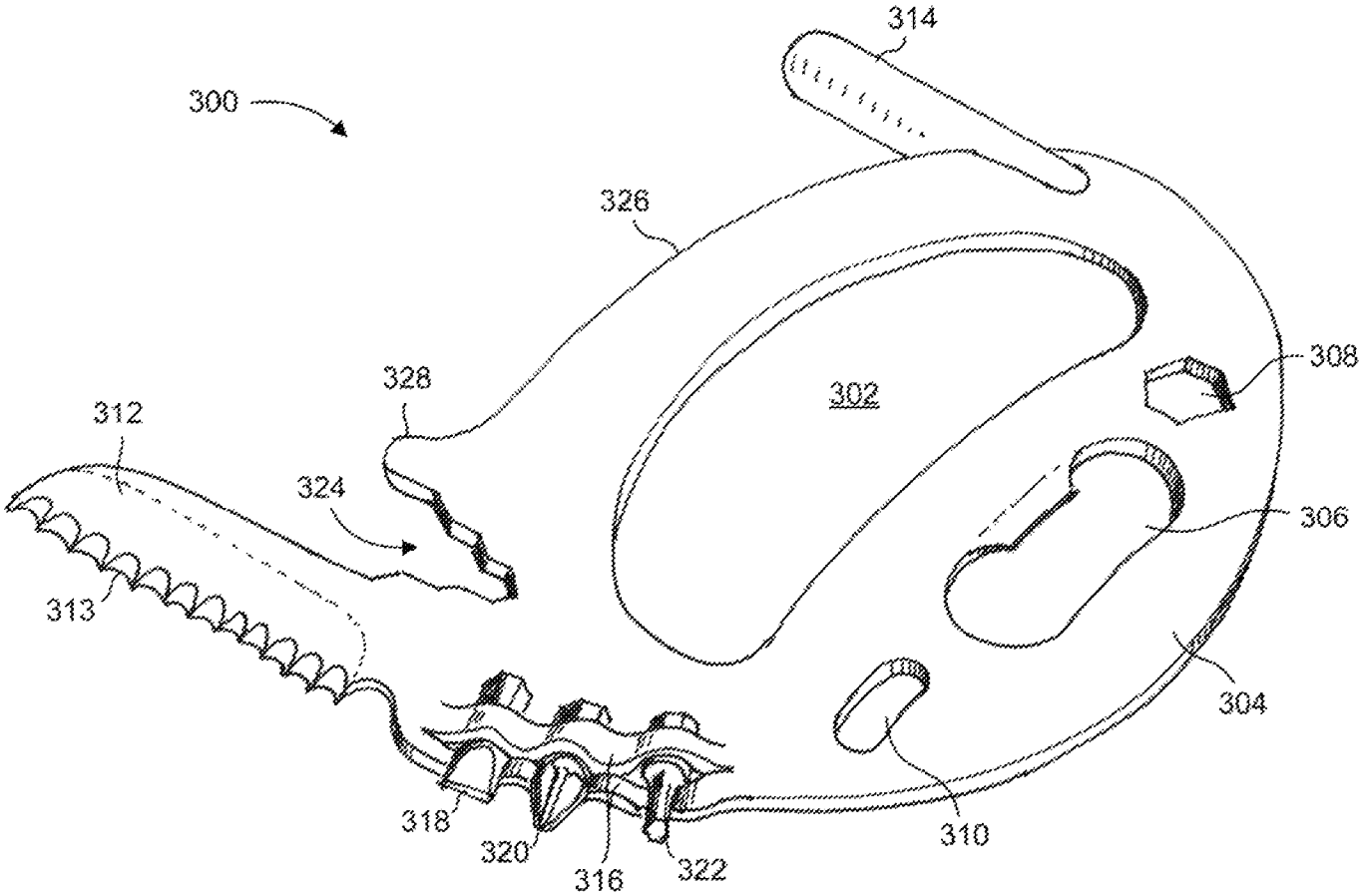
FIG. 13 is a perspective view schematic illustration of an exemplary utility instrument adapted to be retained and concealed within a wearable headgear, constructed and operative in accordance with an embodiment of the disclosed technique.
Figure 14:
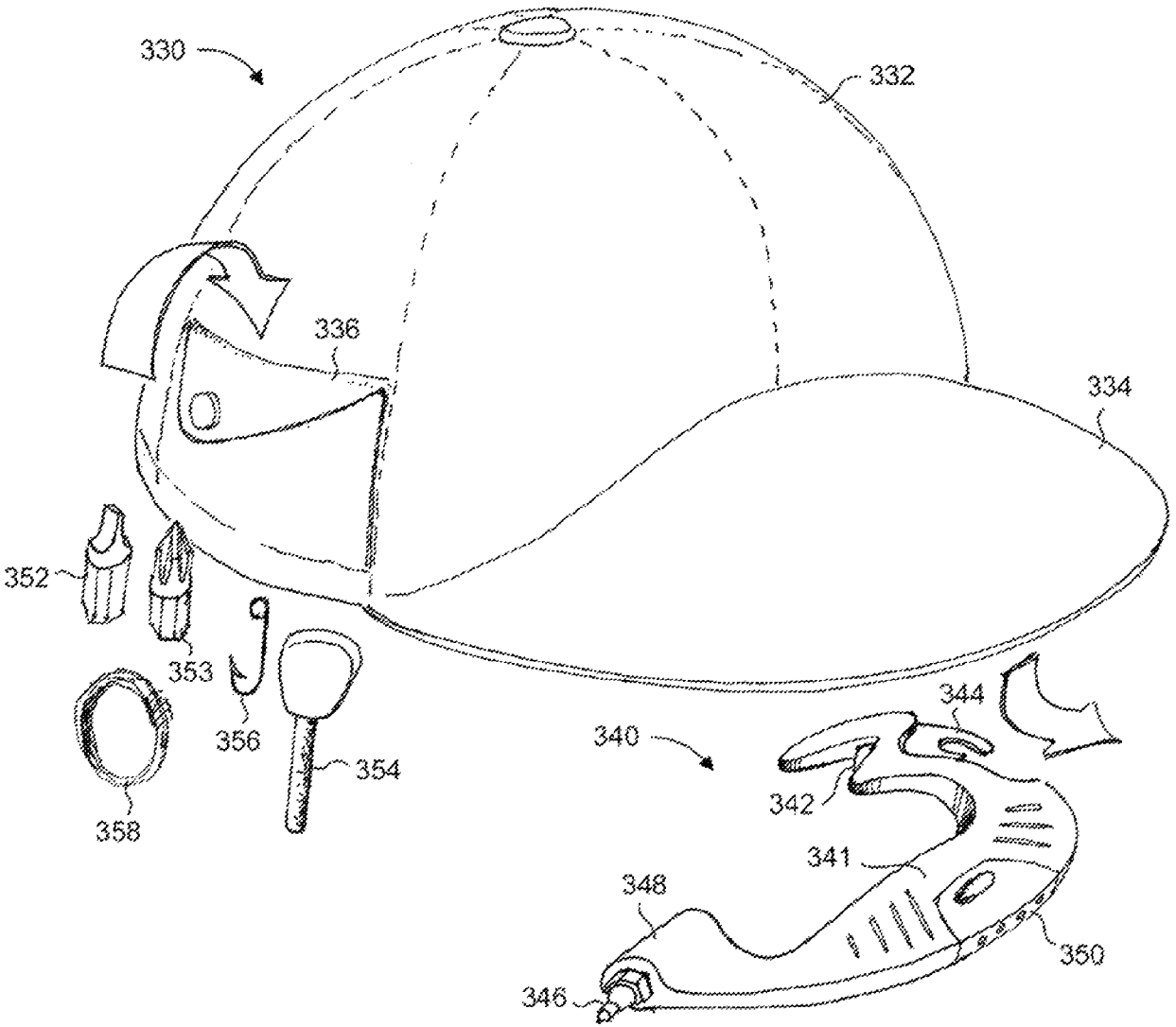
FIG. 14 is a perspective view schematic illustration of another exemplary utility instrument and a cap adapted to retain and conceal the utility instrument and associated components, constructed and operative in accordance with another embodiment of the disclosed technique.
Figure 15:
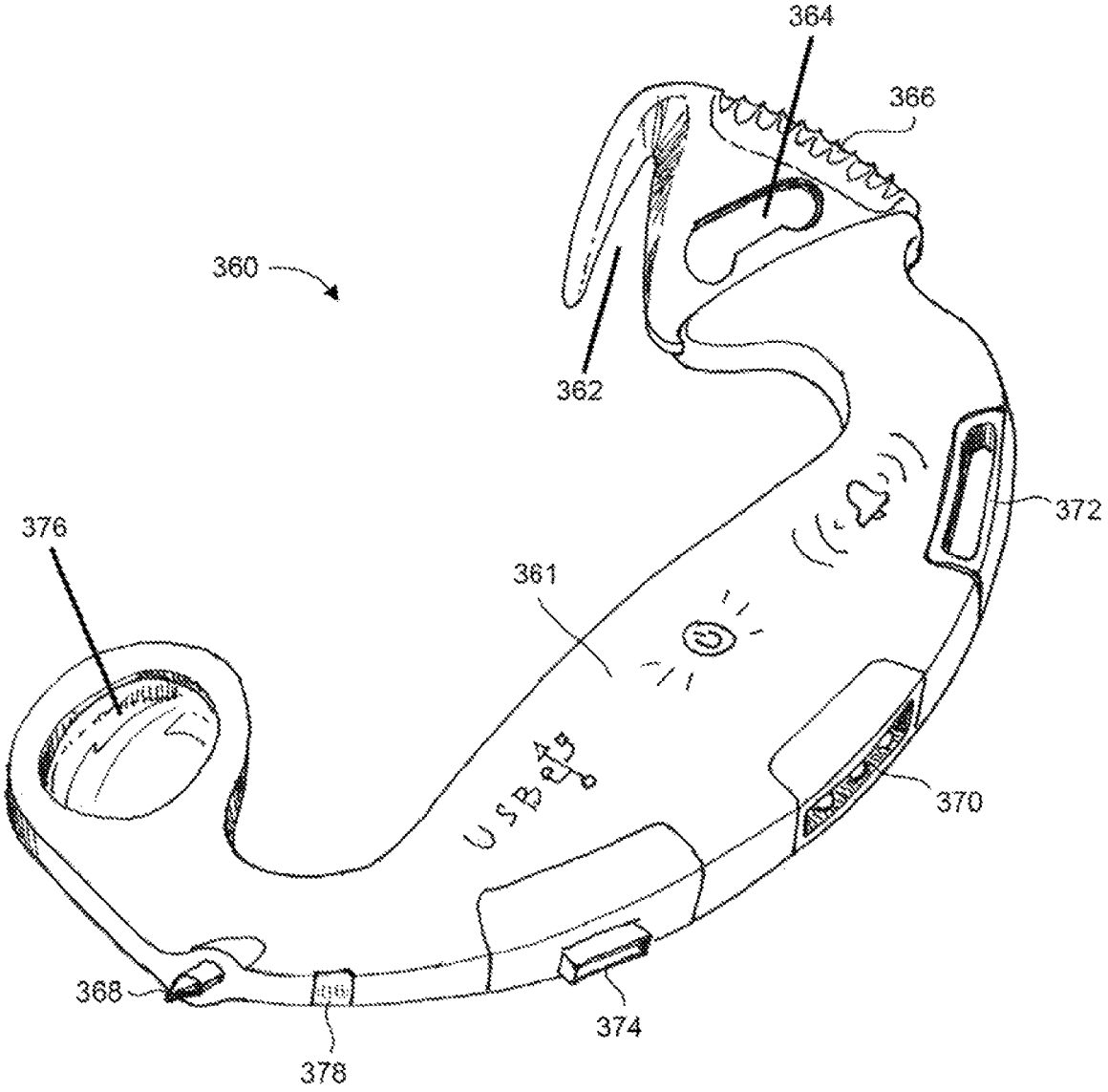
FIG. 15 is a perspective view schematic illustration of a further exemplary utility instrument adapted to be retained and concealed within a wearable headgear, constructed and operative in accordance with a further embodiment of the disclosed technique.
Figure 16:
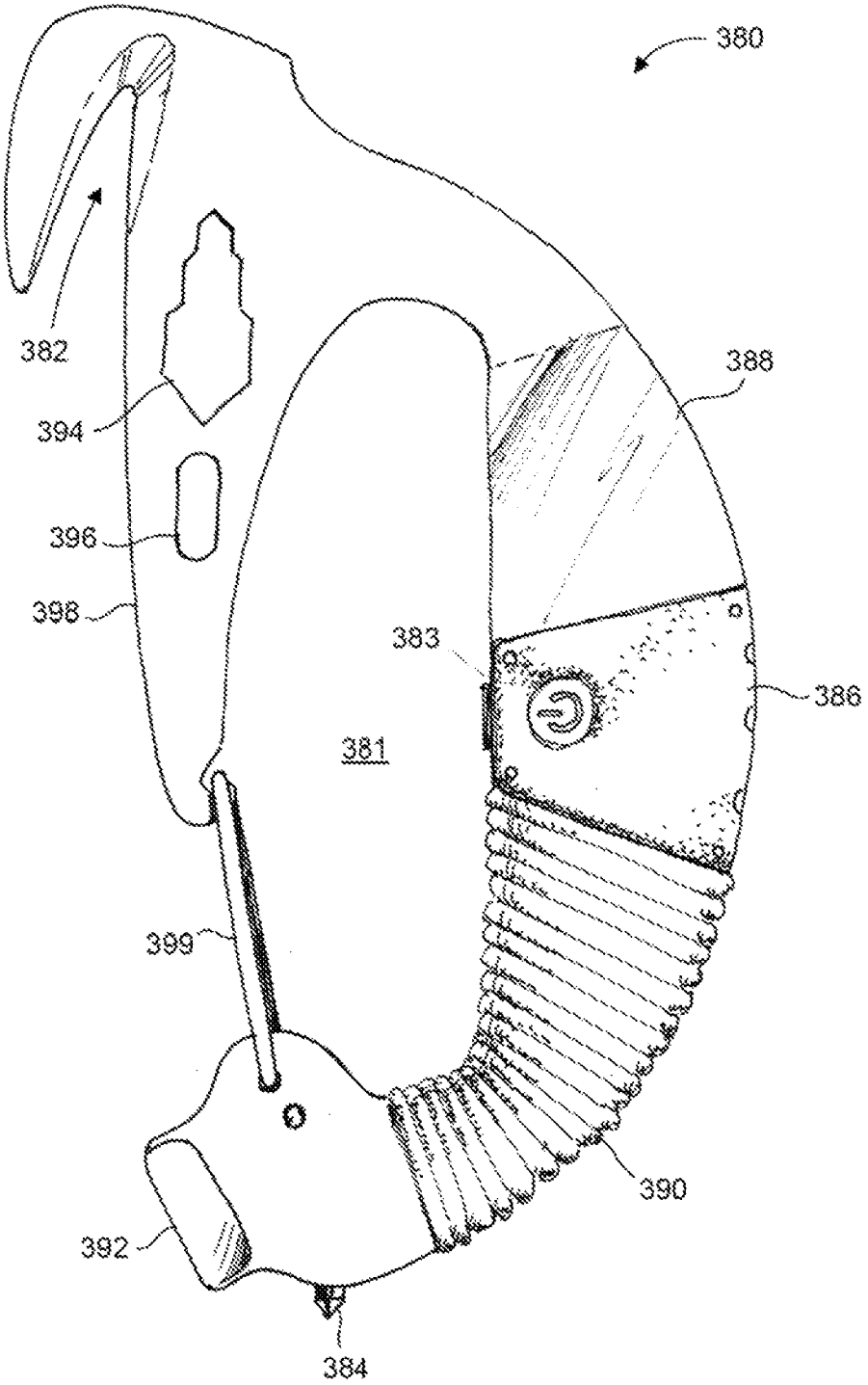
FIG. 16 is a perspective view schematic illustration of yet another exemplary utility instrument adapted to be retained and concealed within a wearable headgear, constructed and operative in accordance with yet another embodiment of the disclosed technique.

According to other embodiments of the disclosed technique, a wearable headgear may be adapted to securely retain and conceal other types of utility instruments besides a weapon. The term "utility instrument" as used herein refers to any type of instrument, device, tool, or utensil that is utilized by a person for at least one task or objective. Accordingly, the term "utility instrument" includes, but is not limited to, a weapon. It is noted that a single utility instrument may include multiple features or components, each of which is operative to enable the utility instrument to be utilized for a specific task. Reference is now made to FIGS. 13, 14, 15 and 16. FIG. 13 is a perspective view schematic illustration of an exemplary utility instrument, generally referenced 300, adapted to be retained and concealed within a wearable headgear, constructed and operative in accordance with an embodiment of the disclosed technique. FIG. 14 is a perspective view schematic illustration of another exemplary utility instrument, generally referenced 340, and a cap, generally referenced 330, adapted to retain and conceal the utility instrument (340) and associated components, constructed and operative in accordance with another embodiment of the disclosed technique. FIG. 15 is a perspective view schematic illustration of a further exemplary utility instrument, generally referenced 360, adapted to be retained and concealed within a wearable headgear, constructed and operative in accordance with a further embodiment of the disclosed technique. FIG. 16 is a perspective view schematic illustration of yet another exemplary utility instrument, generally referenced 360, adapted to be retained and concealed within a wearable headgear, constructed and operative in accordance with yet another embodiment of the disclosed technique.

Referring to FIG. 13, utility instrument 300 includes an arc-shaped rear edge, an arc-shaped front edge, and arc-shaped side edges, similar to weapon 120 (FIG. 2) and weapon 220 (FIG. 9). Utility instrument 300 is sized and shaped to fit fully inside the perimeter of the brim of a cap (not shown). Utility instrument 300 includes a central gap 302, a hand grip portion 304, a bottle opener 306, an Allen/hex-bit socket wrench head 308, a cylinder wrench head 310, a side blade 312, a screwdriver bit holder 314, a screw bit magazine 316, a set of screwdriver bits 318, 320 and 322, a multi-sized socket wrench 324, and a rigid front edge 326. Utility instrument 300 may be considered a multi-use tool that includes both weapon features and non-weapon features.

Central gap 302 and hand grip portion 304 are respectively analogous to central gap 130/hand grip portion 132 (weapon 120) and to central gap 222/hand grip portion 224 (weapon 220), operative for allowing the user to insert his/her fingers through gap 302 and securely grip utility instrument 300 with his/her palm positioned over hand grip portion 304 with a partially clenched gripping motion. Front edge 326 is composed of a tough and durable material, typically a metal such as steel, and is utilized similar to "brass knuckles" in order to strike an assailant with a forceful impact. Furthermore, the short protrusion 328 located between socket wrench 324 and front edge 326 may be employed as a focusing point, to provide additional impact when forcefully striking the assailant with the front edge 326 of utility instrument 300, and/or to direct the strike against a particular body region. Blade 312 projects outward from one side of utility instrument 300. Blade 312 includes a serrated inner edge 313 for serrated cutting (similar to serrated blade edges 230A, 230B of weapon 220).

Bottle opener 306 is operative for removing a bottle cap (e.g., the metal bottle caps found in many bottled beverages). Hex-bit (also known as Allen) socket wrench head 308 and multi-sized hex-bit socket wrench 324 is each operative for loosening or tightening a hex socket screw via the application of torque. Hex-bit socket wrench head 308 is matched to fit a particular sized hex screw head, while multi-sized socket wrench 324 includes multiple openings of varying sizes allowing for usage with different sized hex screw heads. Cylinder wrench head 310 is operative for opening or closing a gas cylinder valve, such as in an oxygen cylinder tank. Screwdriver bit magazine 316 holds a set of screwdriver bits, such as a slotted-head bit 318, a Phillips-head bit 320, and a hexagonal-head bit 322, which can be removably attached to the head of a screwdriver, such as the end of screwdriver bit holder 314, for engaging a particular type/sized screw.

Referring to FIG. 14, cap 330 includes a crown section 332 and a brim section 334, and is generally analogous to cap 110 (FIGS. 1A and 1B). Utility instrument 340 is generally crescent-shaped and is sized and shaped to fit fully inside the perimeter of the brim 334 of cap 330. Utility instrument 340 includes a hand grip portion 341, a cord cutter 342, a bottle opener 344, a shank carbide burr 346, a screwdriver bit holder 348, and a flashlight 350. Crown 332 of cap 330 includes a pocket 336 for holding a plurality of accessories for utility instrument 340, such as: a slotted-head screwdriver bit 352, a Phillips-head screwdriver bit 353, a fire starter 354, a fishing hook 356, and a fishing line 358. It is noted that pocket 336 may be situated at any suitable region of cap 330 (e.g., on the crown 332, on the brim 334, at the side, rear or front of cap 330), and cap 330 may further include a plurality of pockets. It is appreciated that cap 330 may include alternative means for retaining accessories for utility instrument 340 (i.e., rather than, or in addition to, a pocket 336), such as via at least one adhesive (e.g., buttons, clips, Velcro® (i.e. hook and loop) fasteners) or via a storage belt affixed to cap 330. Utility instrument 340 is retained and concealed within cap 330, such as being inserted into a pocket situated in the cap brim 334. A user who is wearing cap 330 deploys utility instrument 340 for use by gripping utility instrument 340 via hand grip portion 341 and then pulling outwards (i.e., toward the front in the direction away from cap brim 334), thus withdrawing utility instrument 340 from brim 334.

Utility instrument 340 may be considered a multi-use tool that includes non-weapon features, such as for rescue and wilderness survival tasks. Cord cutter 342 includes a small blade operative for cutting, such as cutting through a seat belt or other type of cord, cable, rope, and the like. Bottle opener 344 is operative for removing a bottle cap (similar to bottle opener 306 of utility instrument 300 (FIG. 13)). Screwdriver bit holder 348 is operative to receive a screwdriver bit, such as slotted-head bit 352 or Phillips-head bit 353, to form an operational screwdriver with the desired screw head type. Carbide burr 346 is operative for cutting or piercing through a hard material surface, such as for breaking a car window made from tempered glass. Flashlight 350 is operative for providing illumination in dark environments. For example, flashlight 350 is composed of multiple small light-emitting diodes (LEDs), which are durable, highly-efficient and consume very little power. Flashlight 350 may optionally be utilized as a rescue beacon, or alternatively as a safety light for a cyclist. It is appreciated that flashlight 350 may be operated by the user either while utility instrument 340 is still retained within cap 330 or after utility instrument 340 has been withdrawn from cap 330. Fire starter 354 is operative for generating fire, and may be embodied for example by a small block with a flint on one side and magnesium (or other highly flammable material) on the other side. Fishing hook 356 and fishing line 358 (along with additional fishing tackle equipment if available) can be employed for catching fish.

Referring to FIG. 15, utility instrument 360 is generally crescent-shaped and is sized and shaped to fit fully inside the perimeter of the brim of a cap (not shown). Utility instrument 360 includes a hand grip portion 361, a cord cutter 362, a bottle opener 364, a sawtooth blade 366, a shank carbide burr 368, a flashlight 370, an alarm 372, a Universal Serial Bus (USB) connector port 374, a magnifying glass 376, and tweezers 378. A user withdraws utility instrument 360 from the cap by gripping utility instrument 360 via hand grip portion 361 and then pulling outwards (i.e., toward the front in the direction away from cap brim).

Utility instrument 360 may be considered a multi-use tool that includes non-weapon features, such as for rescue and wilderness survival tasks. Cord cutter 362 includes a small blade operative for cutting, such as cutting through a seat belt or other type of cord, cable, rope, and the like (similar to cord cutter 342 of utility instrument 340 (FIG. 14)). Bottle opener 364 is operative for removing a bottle cap (similar to bottle openers 306 and 344). Sawtooth blade 366 is operative for serrated cutting (similar to blade 312 of utility instrument 300 (FIG. 13)). Carbide burr 368 is operative for cutting, or piercing through a hard material surface, such as for breaking a car window made from tempered glass (similar to carbide burr 346 of utility instrument 340 (FIG. 14)). Flashlight 370 is operative for providing illumination in dark environments, may be embodied by LEDs, and may be utilized as a rescue beacon or safety light (similar to flashlight 350 of utility instrument 340 (FIG. 14)). Alarm 372 is operative for producing an audible sound. For example, alarm 372 may be employed to produce a distress signal, to signify that the user is being threatened or in danger and request immediate assistance. USB port 374 is operative for connecting with a peripheral device with a USB connector, such as a flash drive or portable memory device, enabling utility instrument 360 to, for example, display data contained on the USB device, such as personal information associated with the user (e.g., blood type, allergies, drug prescriptions, contact people, and the like). Preferably, a USB device associated with the user is also integrated with utility instrument 340 and/or with cap 330. Magnifying glass 376 is operative to produce a magnified image of a viewed object, typically embodied by a convex lens. Tweezers 378 are operative for comfortably grasping and manipulating very tiny items (e.g., a splinter). Tweezers 378 are preferably stored within the body of utility instrument 360 when not in use, such that, for example, the top edge of tweezers 378 is accessible to the user and can be pulled outwards to withdraw tweezers 378 for use.

Referring to FIG. 16, utility instrument 380 is generally crescent-shaped and is sized and shaped to fit fully inside the perimeter of the brim of a cap (not shown). Utility instrument 380 includes a central gap 381, a cord cutter 382, a hand grip portion 383, a shank carbide burr 384, a flashlight 386, a mirror 388, a cord 390, a flattened edge 392, a multi-sized socket wrench 394, a cylinder wrench head 396, a rigid front edge 398, and a shackle 399. A user withdraws utility instrument 380 from the cap by inserting his/her fingers through gap 381 and gripping utility instrument 380 with his/her palm positioned over hand grip portion 383 with a partially clenched gripping motion, and then pulling outwards (i.e., toward the front in the direction away from cap brim).

Utility instrument 380 may be considered a multi-use tool that includes both weapon features and non-weapon features. Cord cutter 382 includes a small blade operative for cutting, such as cutting through a seat belt or other type of cord, cable, rope, and the like (similar to cord cutters 342 and 362). Carbide burr 384 is operative for cutting, puncturing or piercing through a hard material surface (e.g., glass, metal), such as for breaking a car window (similar to carbide burrs 346 and 368). Flashlight 386 is operative for providing illumination in dark environments, may be embodied by LEDs, and may be utilized as a rescue beacon or safety light (similar to flashlights 350 and 370). Mirror 388 is operative for reflecting images, and may be utilized for signaling or for providing visibility of regions that are not directly in the user's current line-of-sight (e.g., behind the user). Cord 390 may be employed, for example, for binding together objects, to facilitate pulling against a fixed surface, to improvise various tools (e.g., building traps for hunting), and for cushioning the grip of utility instrument 380. Flattened edge 392 enables utility instrument 380 to be utilized as a crowbar, e.g., for prying open a crate or a window by applying force as a lever. Multi-sized socket wrench 394 is operative for loosening or tightening a hex socket screw via the application of torque (similar to socket wrench 324 of utility instrument 300 (FIG. 13)). Cylinder wrench head 396 is operative for opening or closing a gas cylinder valve, such as in an oxygen cylinder tank (similar to cylinder wrench head 310 of utility instrument 300 (FIG. 13)). Front edge 398 is composed of a tough and durable material, typically a metal such as steel, and is utilized similar to "brass knuckles" in order to strike an assailant by applying forceful impact (similar to front edge 326 of utility instrument 300 (FIG. 13)). Shackle 399, also known as a "carabiner", is operative for providing a secure connecting link in a rigging system, such as climbing, sailing, caving, or rope rescue scenarios. Shackle 399 may further facilitate carrying utility instrument 380.

A utility instrument according to the disclosed technique (such as exemplary utility instruments 300, 340, 360 and 380) may be retained and concealed within a wearable headgear via any of the mechanisms disclosed hereinabove, for example: by being fully sheathed within a pocket stitched onto the brim of a cap (such as with cap 110 of FIGS. 3A and 3B); being integrally formed together with the cap brim (such as with cap 140 of FIGS. 4A, 4B and 4C); being partially sheathed within a pocket of the cap brim (such as with cap 150 of FIG. 5A); forming a brim that is detachable from the rest of the cap (such as with cap 160 of FIG. 6A or cap 170 of FIG. 7A); being removably affixed to the bottom surface of a cap brim via at least one fastener (such as cap 190 and the fasteners depicted in FIG. 8); or being affixed to the underside of a head-covering section of a headgear (such as yarmulke 290 of FIGS. 12A, 12B and 12C). It is appreciated that a utility instrument according to the disclosed technique may be retained and concealed within any type of wearable headgear, such as any of the exemplary headgear types depicted in FIG. 11. It is further appreciated that a utility instrument according to the disclosed technique may include alternative components, elements, or features that were not explicitly included in any of the exemplary utility instruments discussed hereinabove (for example: a compass, a Global Positioning System (GPS) unit, matches, batteries, a whistle, a flare or rescue beacon, a file, a marlinspike, and the like). A utility instrument of the disclosed technique may be customized for use by a particular category of people, for particular professions, or for particular types of operations (for example: rescue personnel, military personnel, wilderness survival, policemen, firefighters, fishermen, and the like), where the specific components, elements, or features included in that utility instrument are suited to match particular requirements.

It will be appreciated by persons skilled in the art that the disclosed technique is not limited to what has been particularly shown and described hereinabove.

The invention claimed is:

1. A wearable assembly comprising:
- a headgear, comprising:
  - a brim portion, protruding from a crown portion of said headgear; and
  - a fastener, disposed on said brim portion; and
- a weapon, shaped and sized to be securely retained and concealed within said brim portion, said weapon configured to be removably attached to said brim portion via said fastener, said weapon comprising:
  - a hand grip portion sized and configured to allow a wearer of said headgear to securely grip, withdraw and deploy said weapon with one hand with a clenched fist positioned such that the hand substantially covers said hand grip portion, said hand grip portion being accessible to the wearer of said headgear while said weapon is retained within said brim portion, and said hand grip portion comprising an arc-shaped rear edge;
  - a front edge;
  - a first utility portion, projecting outward from a first side of said arc-shaped rear edge of said hand grip portion toward the front edge of said weapon; and
  - a second utility portion, projecting outward from a second side of said arc-shaped rear edge of said hand grip portion toward the front edge of said weapon, opposite of said first side, such that said first utility portion and said second utility portion jut and extend beyond the hand grip portion and along a curve of the arc-shaped rear edge.

2. The wearable assembly of claim 1, wherein said weapon is retained within an interior pocket formed underneath a bottom surface of said brim portion.

3. The wearable assembly of claim 1, wherein said weapon is integrally formed together with said brim portion.

4. The wearable assembly of claim 1, wherein said weapon forms said brim portion, which is detachable from said crown portion.

5. The wearable assembly of claim 1, wherein said fastener is selected from the list consisting of:
- at least one clip;
- at least one hook and loop fastener;
- at least one magnet;
- at least one button;

at least one pin;
at least one snap;
at least one zipper; and
any combination of the above.

6. The wearable assembly of claim 1, wherein at least one of said first utility portion and said second utility portion comprises a blade.

7. The wearable assembly of claim 6, wherein said weapon further comprises at least one trap inlet, indented onto an inner corner of said blade, said trap inlet configured to ensnare or deflect away a weapon of an assailant.

8. The wearable assembly of claim 1, wherein said weapon further comprises a pressure focusing point disposed on an edge of said weapon, said focusing point configured to provide impact when striking an assailant or direct a strike against a particular body region.

9. The wearable assembly of claim 1, wherein said weapon further comprises at least one thumb rest configured for resting a thumb against when gripping said weapon.

10. The wearable assembly of claim 1, wherein said weapon further comprises:
an arc-shaped front edge; and
a frontal blade, disposed on said front edge.

11. The wearable assembly of claim 1, wherein said weapon further comprises a lanyard hole, configured for inserting a lanyard therethrough to enable said weapon to be secured to said wearer while being wielded, carried or worn, or withdrawn from said brim portion, via said lanyard.

12. The wearable assembly of claim 1, further comprising a sheath, securely retained and concealed within said brim portion, said weapon configured to be sheathed within said sheath.

13. The wearable assembly of claim 12, wherein said sheath is removably attached to said brim portion, and wherein said weapon and said sheath are configured to be detached from said brim portion together when withdrawn and deployed.

14. The wearable assembly of claim 1, wherein said weapon is selected from the list consisting of: a crescent-shaped weapon; brass knuckles; a double bladed knife; a boomerang weapon; a karambit; a push dagger; a knife; a ninja star; and any combination of the above.

15. The wearable assembly of claim 1, wherein said headgear is selected from the list consisting of:
an open-top visor;
a baseball cap;
a double-brimmed hat;
a motorcycle helmet;
a bicycle helmet;
a firefighting helmet;
a construction helmet;
a cowboy hat;
a sun hat;
a sombrero; and
a yarmulke.

16. The wearable assembly of claim 1, wherein at least one of said first utility portion and said second utility portion is selected from the list consisting of: a cord cutter; a bottle opener; a hex-bit socket wrench head; a cylinder wrench head; a knife; a serrated blade; a screwdriver bit holder; a screw bit magazine; screwdriver bits; a rigid front edge/brass knuckles; a shank carbide burr; a flashlight; a fire starter; a fishing hook; a fishing line; an alarm; a USB port; a magnifying glass; tweezers; a mirror; a flattened edge/crowbar; a shackle/carabiner; a compass; a GPS unit; matches; batteries; a whistle; a flare; a file; a marlinspike; and a covering, operative to conceal at least one feature of said weapon.

17. The wearable assembly of claim 1, wherein said headgear further comprises a pocket, configured to hold at least one accessory associated with said weapon.

18. A weapon, shaped and sized to be securely retained and concealed within a brim portion of a wearable headgear, said weapon configured to be removably attached to said brim portion via a fastener disposed on said brim portion, said weapon comprising:
a hand grip portion sized and configured to allow a wearer of said headgear to securely grip, withdraw and deploy said weapon with one hand with a clenched fist positioned such that the hand substantially covers said hand grip portion, said hand grip portion being accessible to the wearer of said headgear while said weapon is retained within said brim portion, and said hand grip portion comprising an arc-shaped rear edge;
a front edge;
a first utility portion, projecting outward from a first side of said arc-shaped rear edge of said hand grip portion toward the front edge of said weapon; and
a second utility portion, projecting outward from a second side of said arc-shaped rear edge of said hand grip portion toward the front edge of said weapon, opposite of said first side, such that said first utility portion and said second utility portion jut and extend beyond the hand grip portion and along a curve of the arc-shaped rear edge.

19. A wearable headgear comprising:
a brim portion protruding from a crown portion of said headgear; and a fastener, disposed on said brim portion; wherein a weapon is adapted to be securely retained and concealed within said brim portion, said weapon configured to be removably attached to said brim portion via said fastener, said weapon comprising:
a hand grip portion sized and configured to allow a wearer of said headgear to securely grip, withdraw and deploy said weapon with one hand with a clenched fist positioned such that the hand substantially covers said hand grip portion, said hand grip portion being accessible to the wearer of said headgear while said weapon is retained within said brim portion, and said hand grip portion comprising an arc-shaped rear edge;
a front edge;
a first utility portion, projecting outward from a first side of said arc-shaped rear edge of said hand grip portion toward the front edge of said weapon; and
a second utility portion, projecting outward from a second side of said arc-shaped rear edge of said hand grip portion toward the front edge of said weapon, opposite of said first side, such that said first utility portion and said second utility portion jut and extend beyond the hand grip portion and along a curve of the arc-shaped rear edge.

* * * * *